US010948142B2

(12) United States Patent
Trang

(10) Patent No.: US 10,948,142 B2
(45) Date of Patent: Mar. 16, 2021

(54) UNIVERSAL TROFFER RETROFIT ASSEMBLY

(71) Applicant: Nhien Trang, San Jose, CA (US)

(72) Inventor: Nhien Trang, San Jose, CA (US)

( * ) Notice: Subject to any disclaimer, the term of this patent is extended or adjusted under 35 U.S.C. 154(b) by 0 days.

(21) Appl. No.: 16/920,419

(22) Filed: Jul. 2, 2020

(65) Prior Publication Data

US 2020/0332974 A1 Oct. 22, 2020

Related U.S. Application Data

(63) Continuation of application No. 15/971,285, filed on May 4, 2018, now Pat. No. 10,704,750.

(60) Provisional application No. 62/577,714, filed on Oct. 27, 2017.

(51) Int. Cl.

| | |
|---|---|
| ***F21S 8/00*** | (2006.01) |
| ***F21S 8/02*** | (2006.01) |
| ***F21V 21/03*** | (2006.01) |
| ***F21K 9/275*** | (2016.01) |
| ***F21K 9/272*** | (2016.01) |
| ***F21V 5/02*** | (2006.01) |
| ***F21V 21/04*** | (2006.01) |

(Continued)

(52) U.S. Cl.

CPC ..... *F21S 8/026* (2013.01); *F21K 9/272* (2016.08); *F21K 9/275* (2016.08); *F21V 5/02* (2013.01); *F21V 21/03* (2013.01); *F21V 21/048* (2013.01); *F21Y 2103/10* (2016.08); *F21Y 2115/10* (2016.08)

(58) Field of Classification Search

CPC ..... F21Y 2103/00; F21Y 2101/00; F21Y 2103/10; F21V 19/001; F21V 21/04; F21V 21/03; F21V 15/01; F21V 17/107; F21V 17/10; F21V 17/164; F21V 21/30; F21K 9/27; F21S 8/026; F21S 8/02; F21S 8/04; E04B 9/003

See application file for complete search history.

(56) References Cited

U.S. PATENT DOCUMENTS 3,383,811 A * 5/1968 Ades ..... E04B 9/003 52/28

4,424,554 A 1/1984 Woloski (Continued)

*Primary Examiner* — William J Carter
*Assistant Examiner* — Omar Rojas Cadima
(74) *Attorney, Agent, or Firm* — Ricky Lam

(57) ABSTRACT

Systems and methods for retrofitting an existing troffer light fixture, or for a new installation application, comprising a housing and a door assembly, wherein the door assembly comprises four side walls, a recessed cavity, a light source, one or more lens, and at least one support extension supporting the assembly are disclosed. The support extension may be a fixed horizontal protrusion of the frame of the retrofit assembly and configured to engage a T-bar of a ceiling system. The protrusion may rest on a horizontal portion of the T-bar to thereby support the assembly. Existing troffer light fixtures can be retrofitted to include a more efficient light source, replace components of a damaged troffer style light fixture, and/or otherwise upgrade or replace an existing fixture. The retrofit assembly may enable existing fixtures to be modified from a number of different fixture types without the need to remove and replace components of the existing fixture.

3 Claims, 24 Drawing Sheets

(51) Int. Cl.
*F21Y 103/10* (2016.01)
*F21Y 115/10* (2016.01)

(56) References Cited

U.S. PATENT DOCUMENTS

| | | | | |
|---|---|---|---|---|
| 6,231,213 | B1 * | 5/2001 | Schmidt | F21S 8/02 362/374 |
| 8,100,551 | B2 * | 1/2012 | Mayfield, III | F21V 15/01 362/223 |
| 8,314,336 | B2 | 11/2012 | Liang | |
| 8,956,013 | B1 | 2/2015 | Shew | |
| 10,704,750 | B2 * | 7/2020 | Trang | F21V 5/02 |
| 2010/0142202 | A1 | 6/2010 | Sugishita | |
| 2013/0083514 | A1 * | 4/2013 | Wong | F21S 8/026 362/147 |
| 2014/0071665 | A1 * | 3/2014 | Huang | F21V 23/008 362/218 |
| 2015/0267905 | A1 * | 9/2015 | Lee | F21S 8/026 362/150 |
| 2016/0356432 | A1 | 12/2016 | Scribante | |
| 2017/0074473 | A1 * | 3/2017 | Ogg | F21V 23/008 |
| 2017/0356625 | A1 | 12/2017 | Sorensen | |

* cited by examiner

UNIVERSAL TROFFER RETROFIT ASSEMBLY

CLAIMS OF PRIORITY

This patent application is a continuation-in-part and claims priority from:

(1) U.S. utility patent application Ser. No. 15/971,285, entitled 'Universal troffer retrofit assembly', filed May 4, 2018.

(2) U.S. provisional patent application No. 62/577,714, entitled 'Universal troffer retrofit assembly', filed Oct. 27, 2017.

FIELD OF TECHNOLOGY

This disclosure relates generally to techniques for providing a troffer light fixture for use in retrofitting an existing troffer light fixture or in new installation applications.

BACKGROUND

Troffer-based fluorescent light fixtures are ubiquitously found in commercial and institutional settings, such as, e.g., within schools, offices, hospitals, and retail stores. Accordingly, the advent of the fluorescent light tube fixtures has shown to be a significant improvement over incandescent light fixtures within the prior art. The traditional fluorescent light tube fixture comprising fluorescent light tubes and electronic ballast have common drawbacks of high power consumption, short service life, and a fragile structure. Another drawback is the use of rare-earth and other toxic phosphors needed to generate light. Environmental waste hazards from the phosphors may accompany when the tubes that have ceased to function require disposal.

More recently, with the advent of efficient solid state lighting sources, these troffers have been used with light emitting diodes (LEDs), as an example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

An LED fixture may provide numerous advantages over the traditional fluorescent light tube troffer. The electrical power requirements for LED lighting are quite low in comparison to most other forms of lighting, thereby saving energy and increasing efficiency in comparison to other lighting forms. Moreover, the present invention eliminates the need for relatively high step-up voltages, as it is not necessary to ionize gases within a tube, as is done in fluorescent lighting. This greatly reduces the potential hazard of such a system, as the voltage required is considerably lower than the conventional supply voltage, e.g., 110 to 115 volts, in most areas. In addition, LEDs can have a significantly longer operational lifetime of between 50,000 and 70,000 hours. The increased efficiency and extended lifetime of LEDs are attractive to many lighting suppliers and has resulted in LED lights being used in place of conventional lighting in many different applications. Another important advantage of an LED light assembly is the elimination of the potential danger of breakage of the glass seen in a fluorescent light tube.

In some cases, it may be desirable to replace or retrofit existing troffer-style fixtures, which may have fluorescent light bulbs with newer LED emitters. There are a number of patents describing an LED-base light source as a way to replace fluorescent light tubes. LED replacement tubes typically contain a transparent tube with LEDs mounted inside the tube and comprising dual end caps, wherein each end cap is mounted at a respective end of the light tube. Both end caps each typically contain a pair of conductive prongs functioning as connectors so that the tube may be inserted into respective sockets within a fluorescent tube troffer, for example, thereby electronically communicating with the electronic ballast system of the fluorescent troffer. These LED replacement light tubes are therefore intended for retrofitting into an existing fluorescent light fixture.

However, it may be a challenge to design a system which allows for quick and easy universal retrofitting of a variety of existing troffer light fixtures. Traditional fluorescent tube troffer may be complex in its assembly, and may require an electronic ballast to power the fluorescent tubes in addition to extensive wiring required to connect the electronic ballast to the socket holders at both ends of the troffer. In addition, different light fixture manufacturers may position holes in a variety of configurations, and existing prior art assemblies that utilizes these holes for installation may not be adaptable and it may be very difficult to customize to the same dimensions of the holes of the existing light fixture. Therefore, there is a need for a troffer fixture universal in design, size and shape of a traditional fluorescent light tube fixture while offering compatible electronics to power LEDs as its light source.

SUMMARY

In one aspect, the present invention discloses a system and a method for retrofitting an existing troffer light fixture, or for a new installation application, comprising a troffer housing and a door assembly, wherein the door assembly comprises four side walls, a recessed cavity, a light source, one or more lens, and at least one support extension for installing and supporting the assembly. The light source may be any device or component configured to produce visible light, and may be disposed on one or more components of the door assembly such that light is emitted within the assembly and exits through one or more lens, e.g., within the door assembly at a top portion. The light source may comprise hardware, such as, e.g., terminals and lamp holders, and may be electrically coupled to additional components, such as, e.g., ballast, and one or more controllers. Existing troffer light fixtures can be retrofitted to include a more efficient light source, replace components of a damaged troffer style light fixture, and/or otherwise upgrade or replace an existing troffer light fixture. A retrofit assembly of the present invention may enable existing light fixtures to be modified from a number of different light fixture types without the need to remove and replace all of the components of the existing light fixture. In this way, the present invention offers a fast and quick solution for retrofitting a plurality of different light sources to provide a singular uniform lighting source that is preferably more energy efficient and cost-effective than the existing light fixtures. While LED is specifically used in many of the examples described, other types of lamps or light sources, such as, e.g., fluorescent lamps, halogen lamps, incandescent lamps, organic LEDs, incandescent lamps, discharge lamps, liquid crystal displays, and plasma displays may be used in varying embodiments.

The retrofit assembly may be used to replace the existing troffer light fixture, and its less efficient lamps, in part while retaining the existing troffer housing, ballast, wiring, and/or other components. The support extensions may be a fixed horizontal protrusion of the frame of the retrofit assembly and configured to engage a T-bar of a ceiling system. The protrusion may rest on a horizontal portion of the T-bar to thereby support or secure the assembly within the ceiling system. The protrusion may optionally be secured to the T-bar such that movement of the assembly is minimized or eliminated, such as, e.g., in an event of an earthquake. For example, the support extension may comprise one or more holes to be attached to a support structure, e.g., the T-bar, by wire or another support device.

In some aspects, the support extension may be integrated within the frame of the retrofit assembly, such as, e.g., by injection molding, casting, machining, and/or welding; and in other embodiments, it may be a separate structure such that it is removably attached to the assembly, such as, e.g., using screws, nuts and bolts, rivets, or an adhesive. The support extension may be made from a same material as the top panel, or recessed cavity, and edge panels of the retrofit assembly and may include a metal, such as, e.g., aluminum, steel, tin or alloys, and/or a polymer, such as, e.g., acrylic, polycarbonate or polyvinyl chloride, and/or an organic material, such as, e.g., wood. Alternatively, the support extension may be constructed of a material different from those of the top panel and edge panels of the retrofit assembly.

BRIEF DESCRIPTION OF THE DRAWINGS

Example embodiments are illustrated by way of example and are not limited to the figures of the accompanying drawings, in which, like references indicate similar elements.

DETAILED DESCRIPTION

Figure 1:
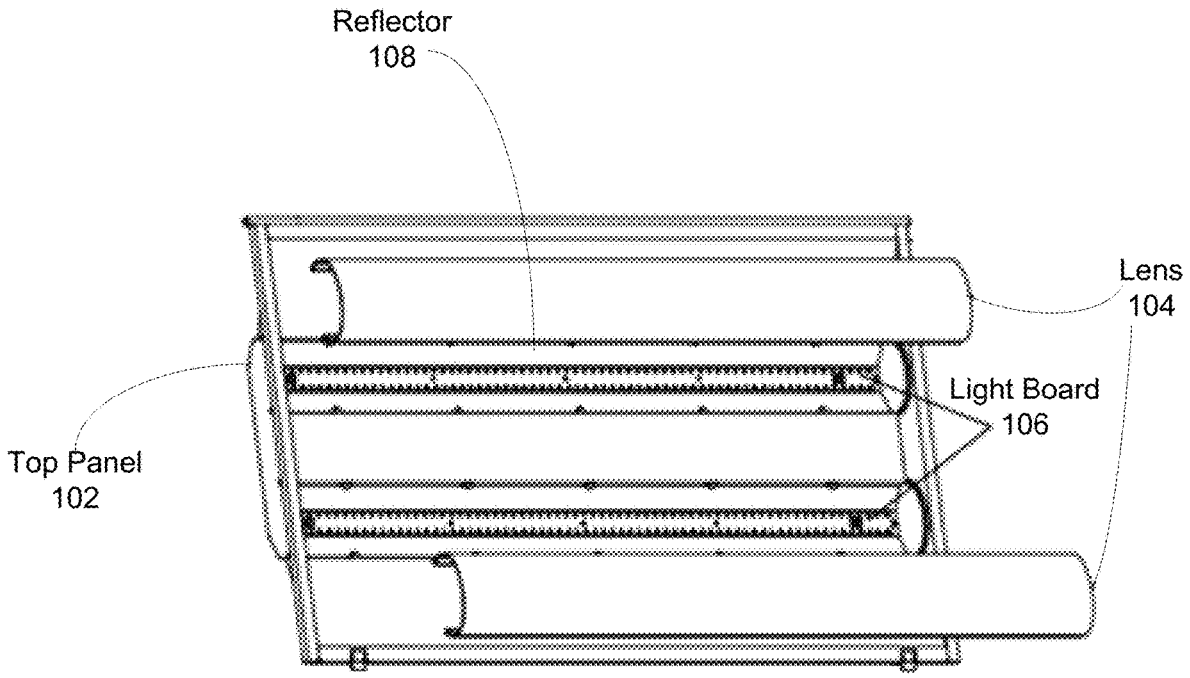
FIG. 1 is a partial exploded perspective view of a sample light fixture which illustrates internal components.

Disclosed are a system and a method for providing a universal troffer light fixture for use in retrofitting an existing troffer light fixture or in new installation applications. Although the present embodiments have been described with reference to specific example embodiments, it will be evident that various modifications and changes may be made to these embodiments without departing from the broader spirit and scope of the various embodiments. In addition, the components shown in the figures, their connections, couples, and relationships, and their functions, are meant to be exemplary only, and are not meant to limit the embodiments described herein.

In at least one embodiment, the present invention discloses a system and a method for retrofitting an existing troffer light fixture, or for a new installation application, comprising a troffer housing and a door assembly, wherein the door assembly comprises four side walls, a recessed cavity, a light source, one or more lens, and at least one support extension for installing and supporting the assembly. The light source may be any device or component configured to produce visible light, and may be disposed on one or more components of the door assembly such that light is emitted within the assembly and exits through one or more lens, e.g., within the door assembly at a top portion. The light source may comprise hardware, such as, e.g., terminals and lamp holders, and may be electrically coupled to additional components, such as, e.g., ballast, and one or more controllers. Existing troffer light fixtures can be retrofitted to include a more efficient light source, replace components of a damaged troffer style light fixture, and/or otherwise upgrade or replace an existing troffer light fixture. A retrofit assembly of the present invention may enable existing light fixtures to be modified from a number of different light fixture types without the need to remove and replace all of the components of the existing light fixture. In this way, the present invention offers a fast and quick solution for retrofitting a plurality of different light sources to provide a singular uniform lighting source that is preferably more energy efficient and cost-effective than the existing light fixtures. While LED is specifically used in many of the examples described, other types of lamps or light sources, such as, e.g., fluorescent lamps, halogen lamps, incandescent lamps, organic LEDs, incandescent lamps, discharge lamps, liquid crystal displays, and plasma displays may be used in varying embodiments.

A troffer light fixture is a generally square or rectangular tray-like housing and light source which may be mounted to, or suspended from, a ceiling system. The light fixture may be affixed to the ceiling over an area to be illuminated by any suitable structure known in the art, such as, e.g., fasteners, wire, and/or chain hangers. The troffer may be recessed into the ceiling, with its back side protruding into the plenum area above the ceiling. Typically, elements of the troffer on the back side dissipate heat generated by the light source into the plenum where air can be circulated to facilitate the cooling mechanism. The ceiling system may be a dropped ceiling, ceiling grid and tile system, and/or other engineered ceiling system. The troffer light fixture includes a housing which includes a top body wall and four side body walls. Mounted to the troffer housing are typically lamp sockets, e.g., for fluorescent or LED lamps, lighting ballast which receives electrical power from wiring within the ceiling, and/or other components. The troffer light fixture may further include a door which attaches to the troffer housing. The door may be, or include, a lens and typically opens downward from the troffer housing. Optionally, one or more end caps may be incorporated into the end portions of the lens structure to section off the interior space of the lens for housing electronics, such as, e.g., a light engine.

FIG. 1 is a partial exploded perspective view of a sample light fixture which illustrates internal components. The light fixture may be an existing light fixture coupled to a ceiling system for providing light directly below. The fixture comprising top panel 102 may fit or be placed within a troffer housing. The fixture may comprise one or more lens 104, which may house one or more light board 106. Light board 106 may be any appropriate board, such as, e.g., a PCB or flexible circuit board, and may comprise one or more light emitters, such as, e.g., a LED. The light board 106 and light emitters may include electronics and interconnections necessary to power the light emitters or LEDs. In some embodiments, florescent lamps may be used in substitute. In other embodiments, light board 106 may comprise a PCB with LEDs mounted and interconnected thereon. The LEDs may be arranged individually, or in one or more arrays. For example, LEDs may be mounted in a linear pattern or in clusters spaced a predetermined distance from an adjacent cluster. The length of light board 106 may be variable and adjustable by coupling individual light board 106 together to yield the desired length. One or more reflector 108 may cover most of the interior surfaces of the fixture, such as, e.g., on the back side and/or on both length ends, and may direct light out of, and away from, the fixture. One or both of the end reflector 108 may be movable, slidable and/or rotatable, to accommodate installation. Reflector 108 may be formed from a single piece of material, such as, e.g., aluminum, and/or may comprise a reflective coating, and which may be permanently or removably attached to lens 104. A holding mechanism, such as, e.g., alignment holes, may be used to secure lens 104 in place. Reflector 108 and light board 106 may be mounted with similar fastening mechanisms, such as, e.g., retention clips.

Figure 2A:
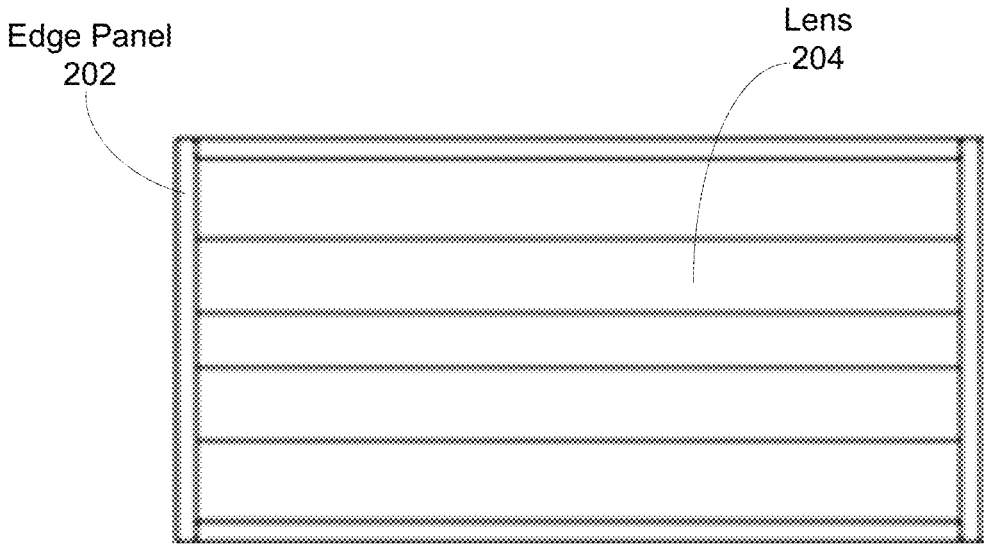
FIG. 2A illustrates a front view of a door assembly of a sample light fixture.

FIG. 2A illustrates a front view of a door assembly of a sample light fixture. The light fixture may be an existing light fixture coupled to a ceiling system for providing light directly below. A frame of the door assembly may comprise a top panel (not seen), a plurality of edge panel 202, and a lens 204. The frame may provide structural support to the door assembly, and may provide one or more mounting locations for additional components of the door assembly. A plurality of edge panel 202 and the top panel may be attached using techniques and hardware known in the art, such as, e.g. welding, rivets, nuts and bolts, and screws. In some embodiments, the frame may be formed from a single edge panel 202. The single piece frame may be formed using techniques such as, e.g., stamping, machining, injection molding, casting, and extruding. The top panel and edge panel 202 may be constructed of a metal, such as, e.g., aluminum, steel, tin, and alloy, and/or plastic or polymer, such as, e.g., acrylic, polycarbonate, and polyvinyl chloride. The top panel and door assembly may enclose the frame made of the plurality, e.g., four, of edge panel 202. The frame may be configured to attach, support, secure, retain, or otherwise interface with the door assembly through mechanisms, such as, e.g., screws, nuts and bolts, rivets, magnets, pressure fit, hinge, and/or adhesives. In some embodiments, lens 204 may be attached and removable from the door assembly. This may allow access to one or more other internal components of the door assembly, such as, e.g., lamps, supply wiring, electronics, and/or controller.

Lens 204 may enhance the performance of the light fixture, such as, e.g., diffusing, focusing, or filtering light form one or more beams emitted from a light source to an area below the door assembly. Additionally, lens 204 may protect one or more components within the door assembly, for example, to limit access to LEDs housed within the door assembly. Lens 204 may be made of a transparent or translucent material, such as, e.g., glass, acrylic, polycarbonate, plastic and/or polymer. In some embodiments, lens 204 may have a substantially flat shape, and may comprise a substantially smooth surface, and may be prismatic comprising a plurality of prisms formed on a surface thereof. The prisms may be disposed on an inner portion of lens 204 to bend light outward from light emitters. The front area of lens 204 may be uniform, or it may comprise varying features and diffusion levels. In other embodiments, portions of lens 204 may be diffusive, whereas other portions may be reflective. Although a double lens configuration in shown for illustration, any variety of configurations may be used, such as, e.g., single lens, triple lens, and curved or contour lens. For example, a triple lens configuration may allow for a complex beam pattern of light emitted by the door assembly due to varying refractive properties of the lens, such as, e.g., light of varying color temperatures or intensities. Single lens may allow for a more uniform beam pattern. Curved or contour lens may focus emitted light with a desired geometry or beam pattern. In alternative embodiments, lens 204 may be oriented other than with the long axes parallel with the long axis of door assembly, such as, e.g., lens 204 may be perpendicular to the long axis of the door assembly. Lens 204 may be a singular piece, or it may be constructed of multiple assembled pieces.

Figure 2B:
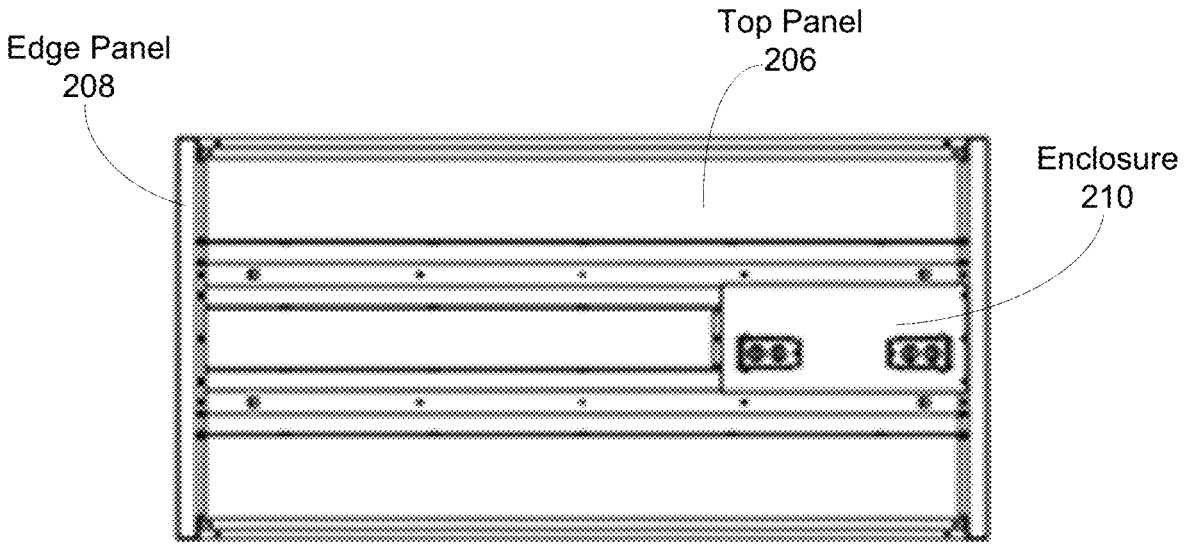
FIG. 2B illustrates a back view of a door assembly of a sample light fixture.

FIG. 2B illustrates a back view of a door assembly of a sample light fixture. The light fixture may be an existing light fixture coupled to a ceiling system for providing light directly below. A frame of the door assembly may comprise a top panel 206, a plurality of edge panel 208 and a lens (not seen). The frame may provide structural support to the door assembly, and may provide one or more mounting locations for additional components of the door assembly. A plurality of edge panel 208 and the top panel may be attached using techniques and hardware known in the art, such as, e.g. welding, rivets, nuts and bolts, and screws. In some embodiments, the frame may be formed from a single edge panel

208. The single piece frame may be formed using techniques such as, e.g., stamping, machining, injection molding, casting, and extruding. The top panel 206 and edge panel 208 may be constructed of a metal, such as, e.g., aluminum, steel, tin, alloy, and/or plastic or polymer, such as, e.g., acrylic, polycarbonate, and polyvinyl chloride. The top panel 206 and door assembly may enclose the frame made of the plurality, e.g., four, of edge panel 208. The frame may be configured to attach, support, secure, retain, or otherwise interface with the door assembly through mechanisms such as, e.g., screws, nuts and bolts, rivets, magnets, pressure fit, hinge, and/or adhesives.

Top panel 206 may support electronics enclosure 210. In some embodiments, enclosure 210 may be disposed within a slot, channel or space of top panel 206 such that enclosure 210 may be equal to, or lower than, the highest surface of top panel 206, or extend not substantially above top panel 206. This may reduce the overall height of the door assembly such that it may be compatible with a greater number of troffer housings of existing troffer light fixtures. In some cases, the lower overall height of the door assembly may reduce the number of components which are required to be removed from the existing troffer light fixture during the retrofit process. For example, the lower overall height of door assembly may allow for ballast of the existing troffer light fixture to remain intact.

Enclosure 210 may house electronic components of the door assembly, such as, e.g., wiring harness, controllers, ballast, and supply wires. An access barrier may allow access to enclosure 210 such that connections to electronic components of the door assembly may be made within the door assembly, e.g., within enclosure 210. This may allow the door assembly to comply with building codes, testing requirements, and/or other requirements related to new construction and/or retrofitting of existing troffer light fixtures. Electronics enclosure 210 may contain wire leads and/or connectors which may be used to connect one or more electronic components of the door assembly, such as, e.g., a driver, to exterior components, such as, e.g., a power supply, sensors, and control circuits. An installer may pass wires from an exterior source, or vice versa, through an opening of enclosure 210, such as, e.g., a hole. The connection between wires may be made using one or more connectors attached to the wires. The connectors may make the connection process easier, faster, and comply with building code requirements by comprising a key-and-lock shape to ensure correct and proper connections, and/or otherwise facilitate the process of wiring the door assembly.

It is understood that a plurality of configurations of the light fixture and/or reflector assemblies may be used to achieve a particular output light profile. The fixtures can be provided in various sizes, including standard troffer fixture sizes, such as, e.g., 2×4 (2 feet by 4 feet) or 2×2 (2 feet by 2 feet). Components and elements of the fixtures may have different dimensions that correspond to the fixture sizes. Additionally, embodiments of the fixture can be customized to fit most any desired fixture dimension.

Figure 3:
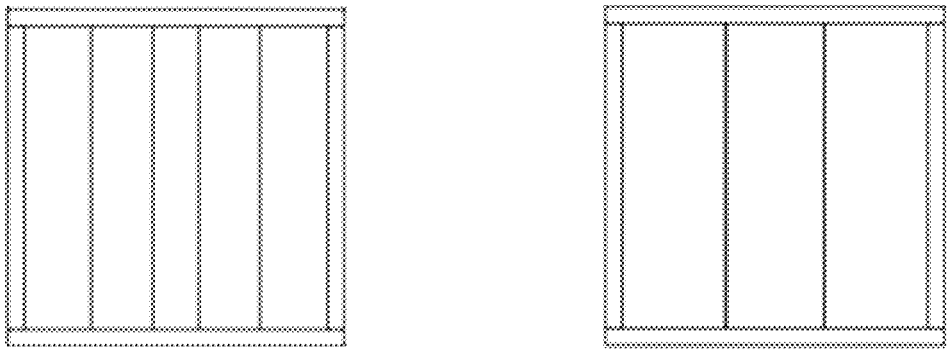
FIG. 3 depicts various lens configuration of a door assembly of a light fixture.

FIG. 3 depicts various lens configuration of a door assembly of a light fixture. The door assembly may be sized squarely rather than as a rectangle as previously illustrated. The square-shape may allow the door assembly to operate with ceiling systems having tiles and existing troffer light fixtures that are, e.g., 2×2 (2 feet by 2 feet), 1×1 (1 feet by 1 feet), or other square dimensions. This is in contrast to the door assemblies of previous figures, which are sized as a rectangle for use in a rectangle ceiling system or a rectangle existing troffer light fixture, e.g., an existing 2×4 (2 feet by 4 feet) troffer light fixture. The components of the square door assembly may be the same components as those in the rectangular door assembly previously described, except resized. Some components may remain the same size depending on compatibility.

Figure 4:
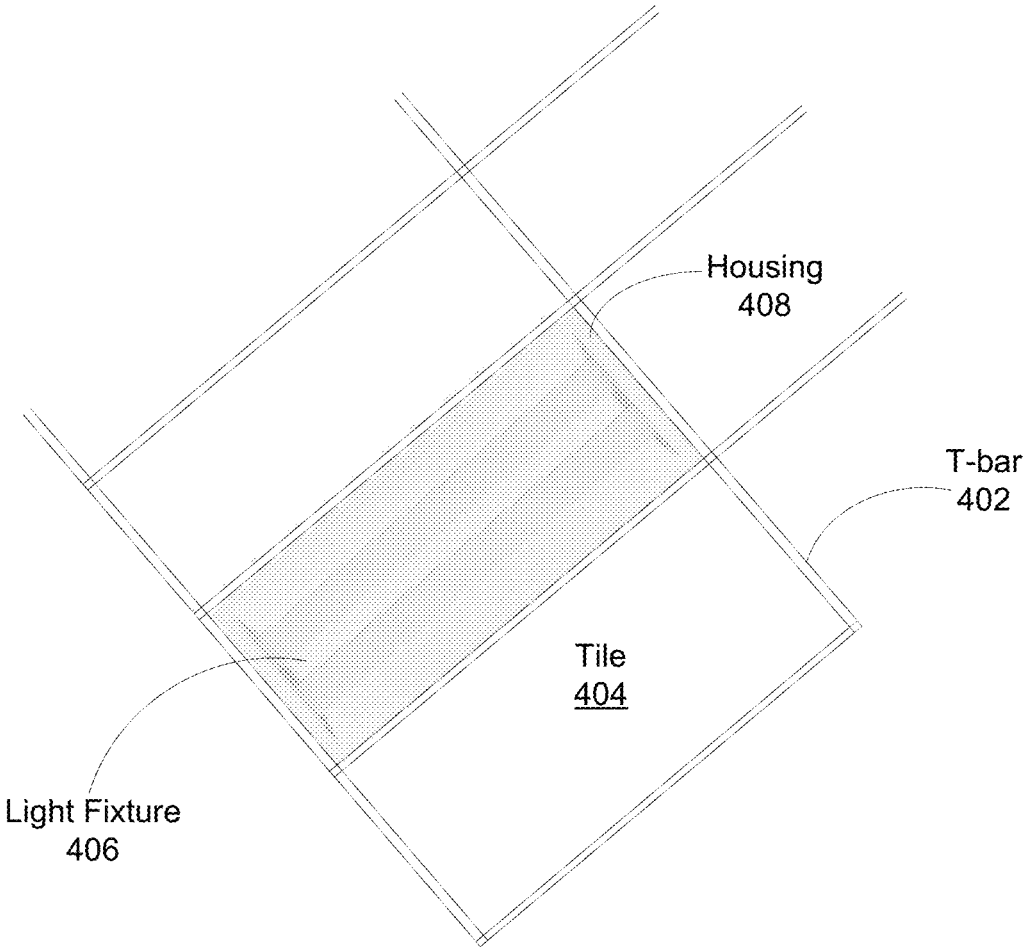
FIG. 4 is a schematic diagram of a ceiling system comprising an existing troffer light fixture, according to at least one embodiment.

FIG. 4 is a schematic diagram of a ceiling system comprising an existing troffer light fixture, according to at least one embodiment. The ceiling system may be a dropped ceiling comprising a plurality of T-bar 402 configured in a grid-like structure for supporting a plurality of ceiling tile 404 and/or light fixture 406. Light fixture 406 may be sized to be compatible with different ceiling system dimensions, such as, e.g., 2×2 or 2×4. Light fixture 406 may be secured by T-bar 402 of the ceiling system in any location sized for a corresponding ceiling tile 404. Troffer housing 408 may contain, secure, and/or support components of light fixture 406, such as, e.g., lens, lamps, ballast, and supply wires. Troffer housing 408 may be secured by T-bar 402 of the ceiling system, e.g., troffer housing 408 may attach to T-bar 402, and may comprise one or more reflectors for directing light emitted down from the ceiling system.

Troffer housing 408 of light fixture 406 may comprise a plurality of slots for allowing a door assembly to removably attach. The door assembly may open and close, such as, e.g., using latches and hinges, to allow access to other components of light fixture 406. For example, the door assembly may be opened to change one or more light board comprising light emitters of light fixture 406. The door assembly may be, or include, one or more lens or louver, and may be removable from troffer housing 408, e.g., unlatched and the hinges removed from the slots of the troffer housing 408. As described herein, the door assembly of light fixture 406 may be removed and the retrofit assembly of the present invention may be installed.

Figure 5:
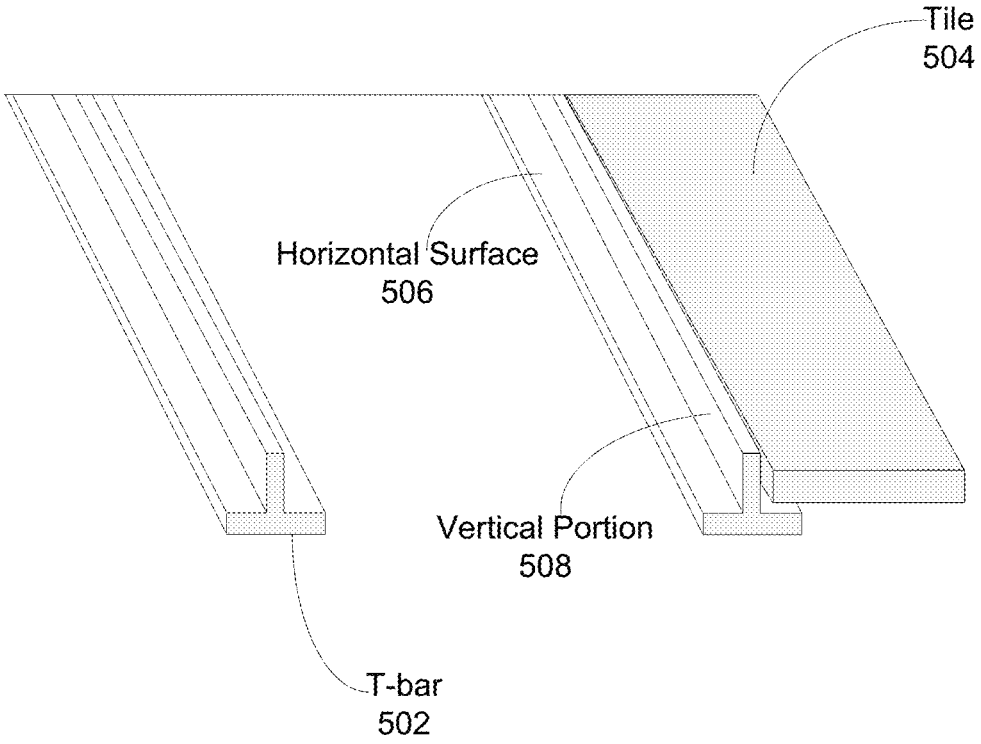
FIG. 5 illustrates a portion of a sample ceiling system.

FIG. 5 illustrates a portion of a sample ceiling system. A plurality of T-bar 502 may be arranged in a grid pattern and configured to support one or more ceiling tile 504. T-bar 502 may be suspended or supported from a structural ceiling, such as, e.g., in a dropped ceiling. One or more sides of a ceiling tile 504, a troffer housing of an existing light fixture, and/or a support extension of a retrofit assembly of the present invention may rest on horizontal surface 506 of T-bar 502 with one T-bar 502 corresponding to each side. Horizontal surface 506 of each T-bar 502 and the spacing of each T-bar 502 in the ceiling grid may prevent the ceiling tile 504, existing light fixture, and/or retrofit assembly from falling through the ceiling system. In addition, vertical portion 508 of T-bar 502 may prevent lateral movement relative to the opening between two adjacent T-bar 502.

Figure 6:
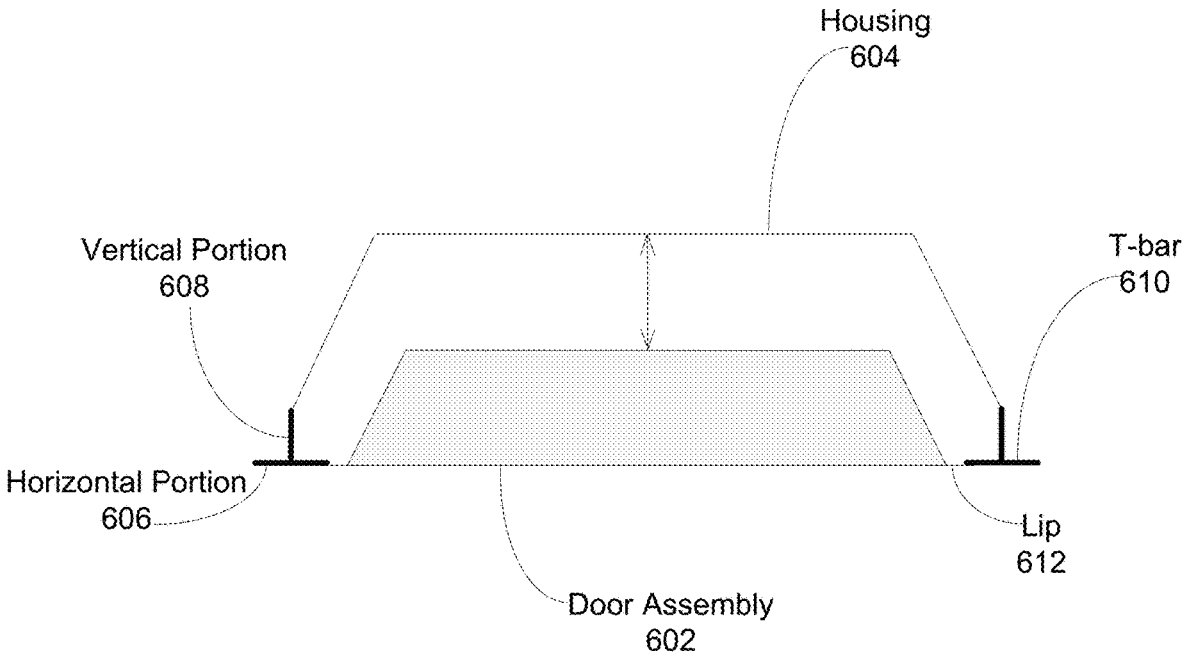
FIG. 6 illustrates a door assembly in relationship to a troffer housing, according to at least one embodiment.

FIG. 6 illustrates a door assembly in relationship to a troffer housing, according to at least one embodiment. Door assembly 602 may be placed within housing 604. Housing 604 may comprise a plurality of slots for allowing door assembly 602 to removably attach. Door assembly 602 may open and close, such as, e.g., using latches and hinges, to allow access to other components of the light fixture. For example, door assembly 602 may be opened to change one or more light board comprising light emitters of the light fixture. Door assembly 602 may be, or include, one or more lens or louver, and may be removable from housing 604, e.g., unlatched and the hinges removed from the slots of the troffer housing 604. As described herein, door assembly 602 may be removed and the retrofit assembly of the present invention may be installed.

Troffer housing 604 may rest on horizontal portion 606 and/or vertical portion 608 of T-bar 610, or it may be secured to T-bar 610, e.g., screwed to T-bar 610, or otherwise permanently attached to the ceiling system. For example, housing 604 may be secured for use in earthquake zones and/or hurricane prone areas, or to comply with one or more building codes or requirements. Lip 612 may optionally be disposed on the outer edges of door assembly 602, extending into its outer perimeter. Lip 612 may overlap with a portion of T-bar 610, and may allow door assembly 602 to be used in ceiling systems comprising a variety of T-bar 610 widths in varying ceiling systems and/or a variety of gap size between a plurality of adjacent T-bar 610. T-bar 610 comprising a narrow width may result in a gap between T-bar 610 and door assembly 602. Lip 612 may extend outward from door assembly 602 and overlap with horizontal portion 606 of T-bar 610 such that lip 612 minimizes or eliminates visible gaps.

In at least one embodiment, the present invention discloses a system and a method for a retrofit assembly comprising four side walls, a recessed cavity, a light source, one or more lens, and one or more support extensions for installing and supporting the assembly. The retrofit assembly may be used to replace the existing troffer light fixture, and its less efficient lamps, in part while retaining the existing troffer housing, ballast, wiring, and/or other components. The support extensions may be a fixed horizontal protrusion of the frame of the retrofit assembly and configured to engage a T-bar of a ceiling system. The protrusion may rest on a horizontal portion of the T-bar to thereby support or secure the assembly within the ceiling system. The protrusion may optionally be secured to the T-bar such that movement of the assembly is minimized or eliminated, such as, e.g., in an event of an earthquake. For example, the support extension may comprise one or more holes to be attached to a support structure, e.g., the T-bar, by wire or another support device.

In some embodiments, the support extension may be integrated within the frame of the retrofit assembly, such as, e.g., by injection molding, casting, machining, and/or welding; and in other embodiments, it may be a separate structure such that it is removably attached to the assembly, such as, e.g., using screws, nuts and bolts, rivets, or an adhesive. The support extension may be made from a same material as the top panel, or recessed cavity, and edge panels of the retrofit assembly and may include a metal, such as, e.g., aluminum, steel, tin or alloys, and/or a polymer, such as, e.g., acrylic, polycarbonate or polyvinyl chloride, and/or an organic material, such as, e.g., wood. In alternative embodiments, the support extension may be constructed of a material different from those of the top panel and edge panels of the retrofit assembly.

The support extension may comprise a variety of configurations, such as, e.g., a rod. The rod may comprise a cylinder shape, cube shape, pyramid or cone shape, or any other polygon shape. The cross section of the rod may be circular, square, triangular, or any other polygonal shape. The length of the support extension may be adjustable for preventing lateral movement of the retrofit assembly by engaging with the vertical portion of a T-bar. Any number and configurations of the support extension may be used, such as, e.g., one, two, three, four or more. If one support extension is used, it may be disposed on a middle section of the retrofit assembly's width or length and may comprise at least two locking plates disposed on the opposing end for balance. The positioning of the support extension and locking plates may form a triangle. If two or more are used, they may be disposed on opposite ends, or the same end, of the retrofit assembly's width or length. One or more locking plates may be used for balance if the support extensions are disposed on the same end. The positioning of the support extensions and locking plates may form a triangle or square.

Figure 7A:
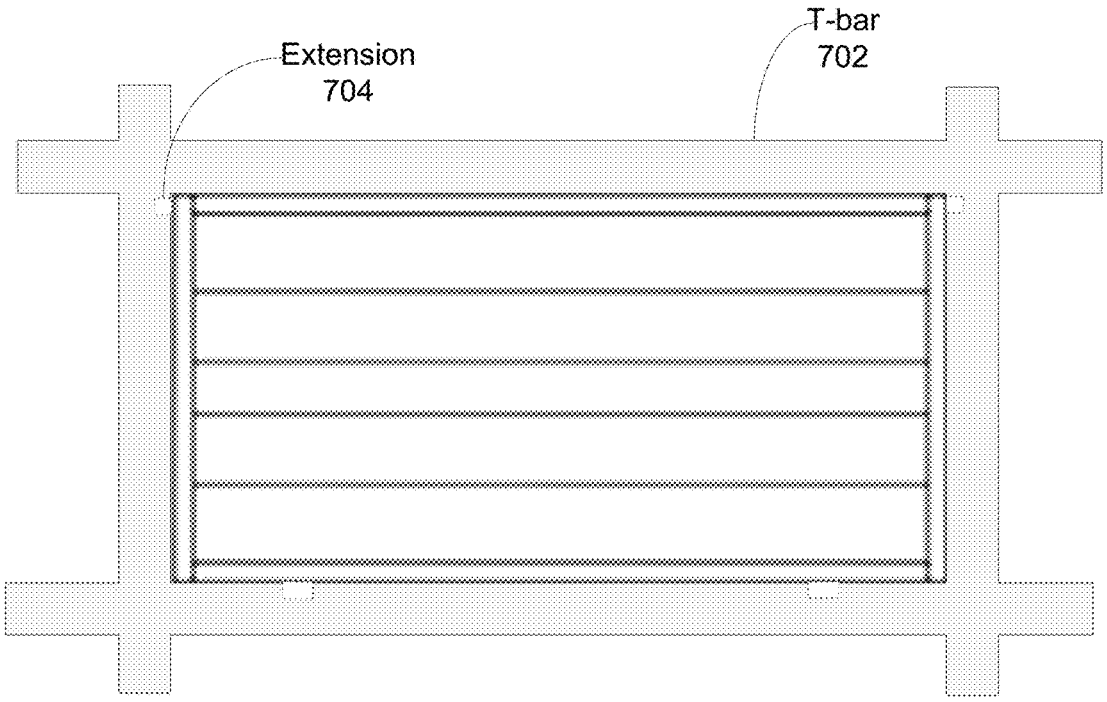
FIGS. 7A-B illustrate a retrofit troffer assembly of the present invention installed in a ceiling system, according to at least one embodiment.
Figure 7B:
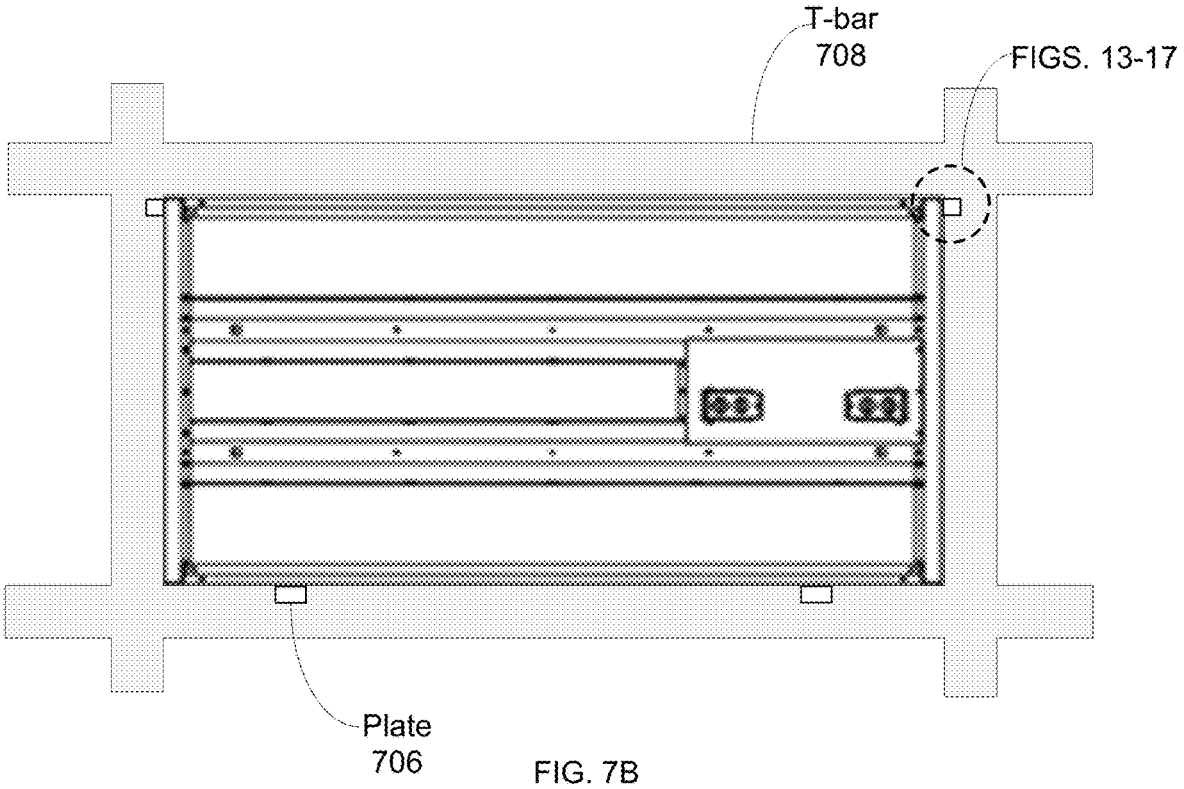

FIGS. 7A-B illustrate a retrofit troffer assembly of the present invention installed in a ceiling system, according to at least one embodiment. The retrofit assembly may be used to upgrade, retrofit, replace, and/or install a lighting fixture in an existing troffer housing. FIG. 7A is a bottom view of the retrofit assembly such that light is emitted from a light board within the troffer housing towards the screen and the viewer, and hence, the ground. The retrofit assembly may be supported on one or more T-bar 702 by a pair of support extension 704 disposed on opposite distal ends of its length. Support extension 704 may give door assembly a width and/or length greater than the separation between a pair of T-bar 702. FIG. 7B is a top view of the retrofit assembly such that light is emitted from a light board within the troffer housing away from the screen and the viewer, and hence, towards the ground. Locking plate 706 may be rotatable such that its length is decreased when angled in the unlock position and increased when straightened in the lock position, and thus may be used during installation of the retrofit assembly and for securing its corresponding side of the assembly onto the ceiling system's T-bar 708. For example, during installation of the retrofit assembly, locking plate 706 may be unlocked so that its shortened length fits within a ceiling system's grid. After the retrofit assembly has fit through the grid, locking plate 706 may be locked such that its length is widen, thus no longer fits through the grid and rests on T-bar 708.

Figure 8A:
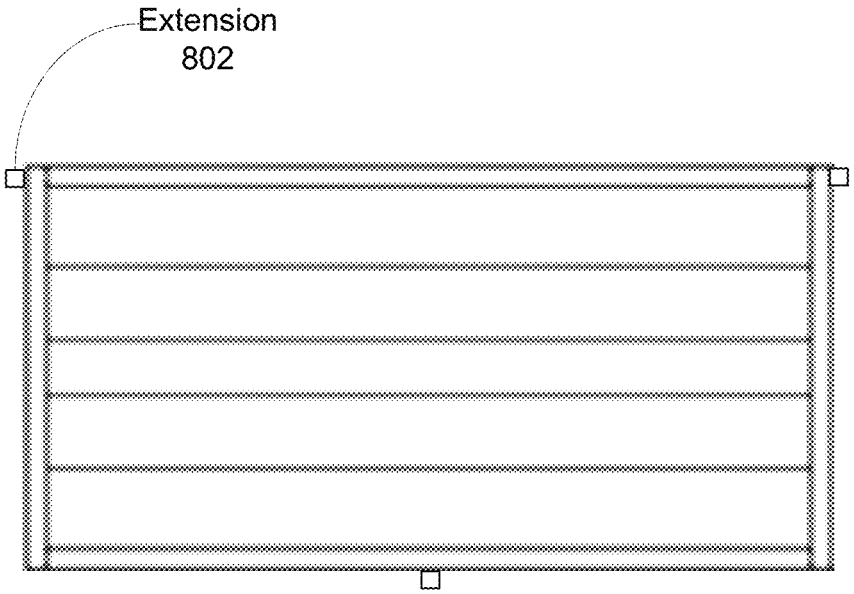
FIGS. 8A-B illustrate alternative configurations for support extensions disposed on a retrofit assembly, according to some embodiments.
Figure 8B:
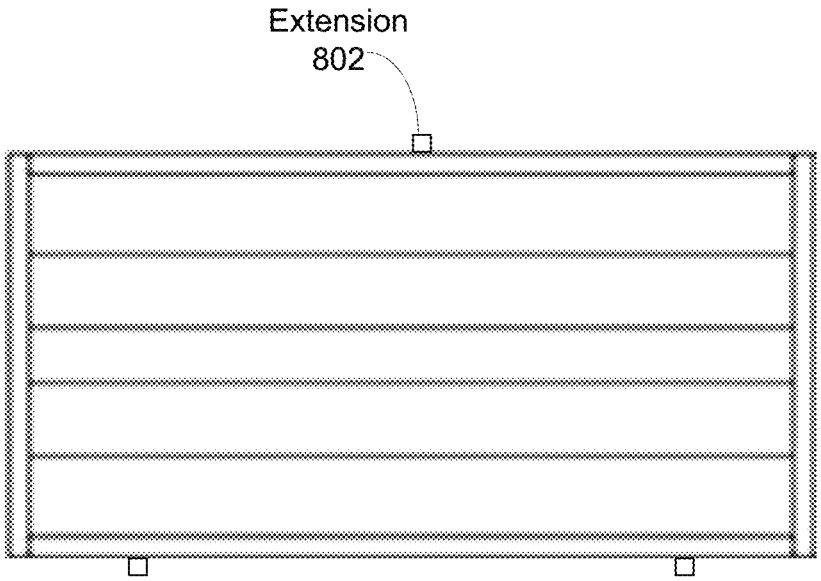

FIGS. 8A-B illustrate alternative configurations for support extensions disposed on a retrofit assembly, according to some embodiments. The retrofit assembly may comprise three support extension 802 configured to engage with T-bars for supporting the weight of the retrofit assembly. FIG. 8A shows a pair of support extension 802 disposed on opposite ends of the retrofit assembly's length, and a single support extension 802 disposed on the assembly's width. Alternatively, the single support extension 802 may be substituted with a locking plate for aiding with the installation. The positioning of the support extension 802 and locking plate may form a triangle. FIG. 8B shows a pair of support extension 802 disposed on the same end of the retrofit assembly's width, and a single support extension 802 disposed on the opposite end of the assembly's width. Alternatively, the single support extension 802 may be substituted with a locking plate for aiding with the installation. The positioning of the support extension 802 and locking plate may form a triangle.

Figure 9A:
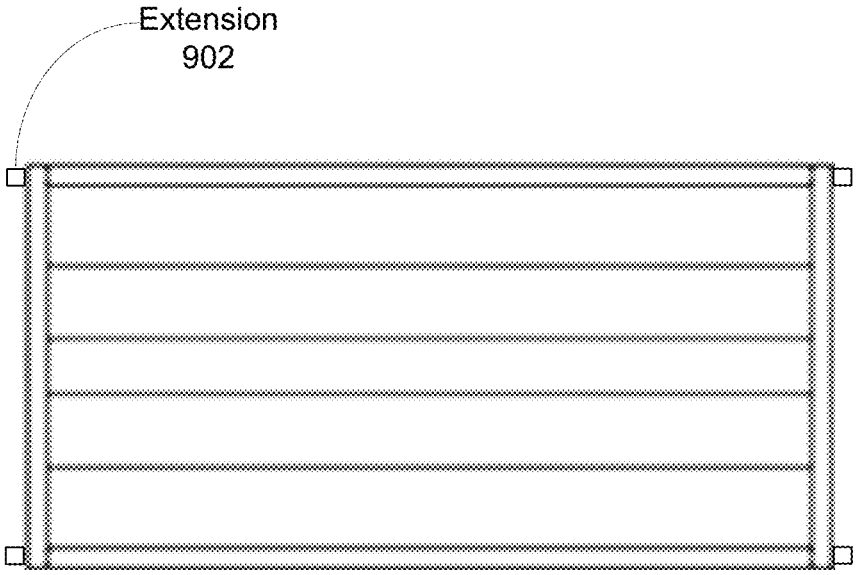
FIGS. 9A-B illustrate alternative configurations for support extensions disposed on a retrofit assembly, according to some embodiments.
Figure 9B:
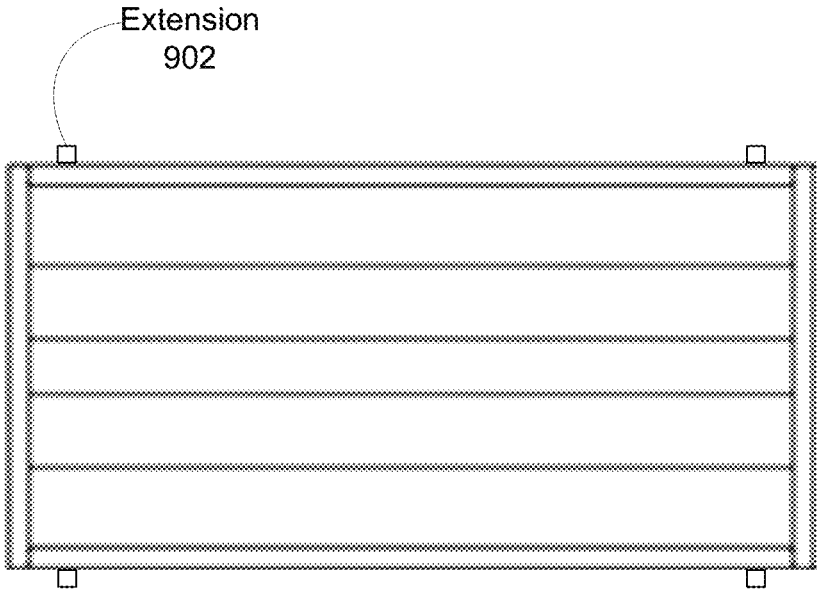

FIGS. 9A-B illustrate alternative configurations for support extensions disposed on a retrofit assembly, according to some embodiments. The retrofit assembly may comprise four support extension 902 configured to engage with T-bars for supporting the weight of the retrofit assembly. FIG. 9A shows two pairs of support extension 902 disposed on opposite ends of the retrofit assembly's length. Alternatively, the two pairs of support extension 902 may be substituted with one or more locking plate for aiding with the installation such that the locking plates are disposed on the same end if two or more are used. The positioning of the support extension 902 and locking plate may form a triangle or square. FIG. 9B shows two pairs of support extension 902 disposed on opposite ends of the retrofit assembly's width. Alternatively, the two pairs of support extension 902 may be substituted with one or more locking plate for aiding with the installation such that the locking plates are disposed on the same end if two or more are used. The positioning of the support extension 902 and locking plate may form a triangle or square. The present invention is not limited to these configurations, and any number of support extensions and/or locking plates may be used.

Figure 10A:
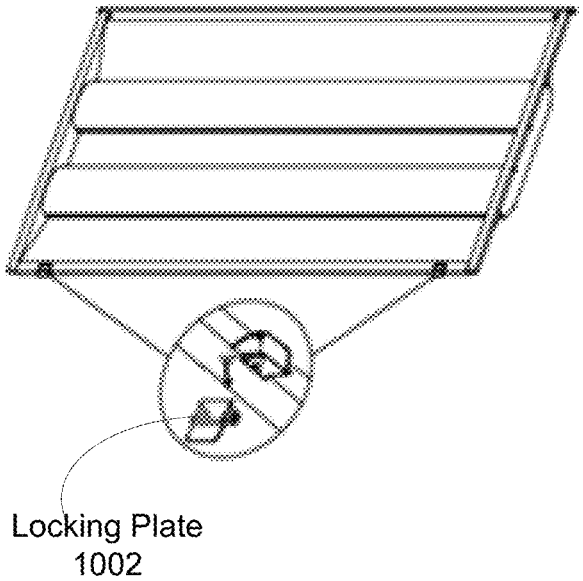
FIGS. 10A-C are enlarged views of various locking mechanisms of the retrofit assembly, according to some embodiments.
Figure 10B:
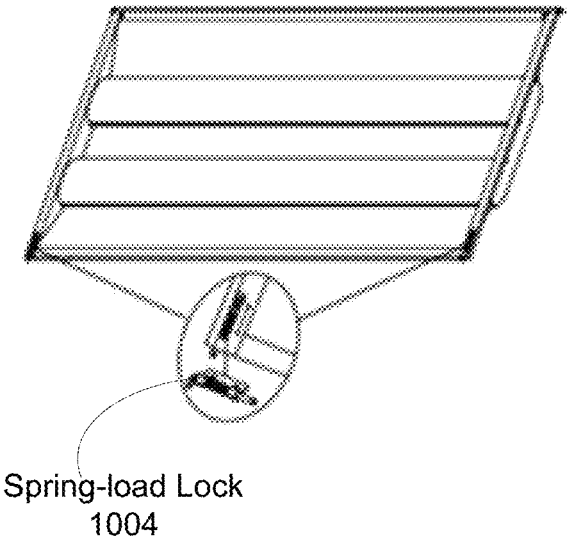
Figure 10C:
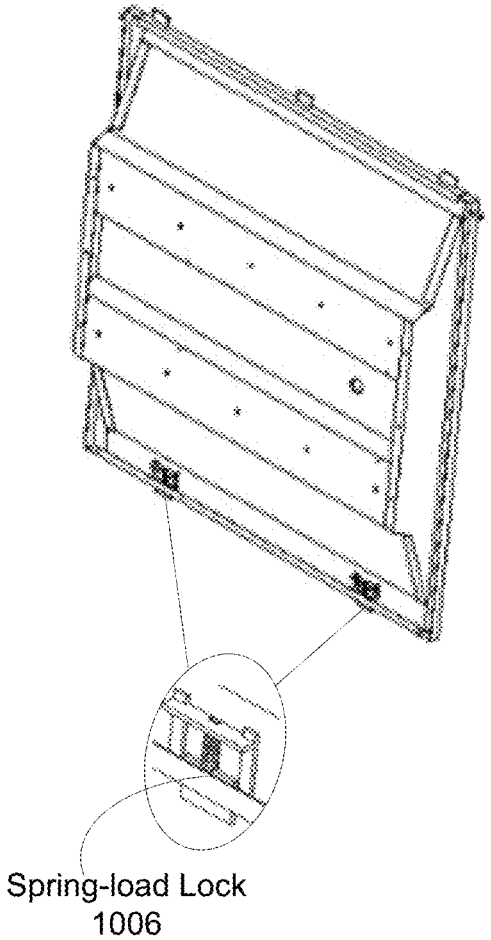

FIGS. 10A-C are enlarged views of various locking mechanisms of the retrofit assembly, according to some embodiments. FIG. 10A shows a pair of locking plate 1002 disposed on the same end of the retrofit assembly's width. Locking plate 1002 may share the function of supporting the weight of the retrofit assembly with a support extension of the present invention. Locking plate 1002 may be interchanged with the support extension for its added function of facilitating installation of the retrofit assembly. For example, locking plate 1002 may be rotatable such that its length is decreased when angled in the unlock position and increased when straightened in the lock position, and thus may be used during installation of the retrofit assembly, and for securing its corresponding side of the assembly onto the ceiling system's T-bar. During installation of the retrofit assembly, locking plate 1002 may be unlocked so that its shortened length fits within a ceiling system's grid. After the retrofit assembly has fit through the grid, locking plate 1002 may be locked such that its length is increased, and thus no longer fits through the grid and therefore rests on the T-bar. FIG. 10B shows spring-load lock 1004 disposed on the same end of the retrofit assembly's width. Spring-load lock 1004 may share the function of supporting the weight of the retrofit assembly with a support extension of the present invention, and may be used interchangeably with the locking plate. Spring-load lock 1004 may be interchanged with the support extension for its added function of facilitating installation of the retrofit assembly. For example, spring-load lock 1004 may comprise an internal pressure source, such as, e.g., a spring or hydraulic, to increase its length when in the rest position and decrease in an unlock position, and thus may be used during installation of the retrofit assembly and for securing its corresponding side of the assembly onto the ceiling system's T-bar. During installation of the retrofit assembly, spring-load lock 1004 may be in the unlock position such that its shortened length fits within a ceiling system's grid. After the retrofit assembly has fit through the grid, spring-load lock 1004 may be put at rest, and in a lock position, such that its length is increased, and thus no longer fits through the grid and therefore rests on the T-bar. FIG. 10C shows an alternative configuration for a spring-load lock. Spring-load lock 1006 may comprise four rectangular surfaces oriented in a square configuration, wherein one of the four surfaces extends beyond a frame or door assembly of the retrofit assembly when set in the rest position. An internal pressure source, such as, e.g., a spring or hydraulic, disposed in a middle portion coupled with a base surface may increase or decrease the extended surface such that the surface does not extend between the frame or door assembly during installation of the retrofit assembly into a ceiling grid. The extended surface may be configured to engage a T-bar of the ceiling grid such that it prevents the retrofit assembly from falling through the grid. Locking plate 1002, spring-load lock 1004 and spring-load lock 1006 may be positioned at a side frame of the retrofit assembly, or at a middle portion of a bottom frame of the retrofit assembly.

Figure 11:
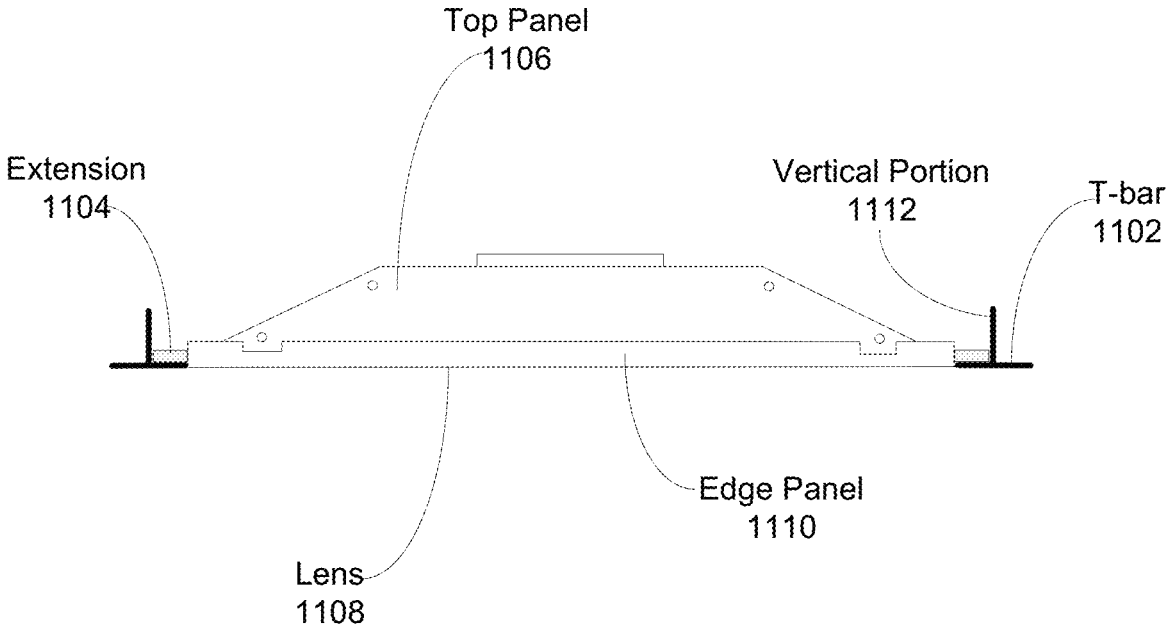
FIG. 11 is a side view of a retrofit assembly of the present invention installed in a ceiling system, according to at least one embodiment.

FIG. 11 is a side view of a retrofit assembly of the present invention installed in a ceiling system, according to at least one embodiment. The retrofit assembly may be supported on one or more T-bar 1102 by a pair of support extension 1104 disposed on opposite ends of its length. The top panel 1106 and lens 1108 may enclose the frame made of a plurality of edge panel 1110, e.g., four. Top panel 1106 may be angled such that the door assembly comprises a trapezoidal cross-section. This may allow the door assembly to fit within a troffer housing of an existing light fixture. In addition, vertical portion 1112 of T-bar 1102 may prevent or limit lateral movement relative to the opening between two adjacent T-bar 1102. In some embodiments, the length of support extension 1104 may be flushed and in direct contact with vertical portion 1112 for perfect fitment. In other embodiments, the length of support extension 1104 may not contact vertical portion 1112 such that there may be a gap between the end portion, e.g., edge, of support extension 1104 and vertical portion 1112. This may allow for universal fitment between varying ceiling systems.

Figure 12:
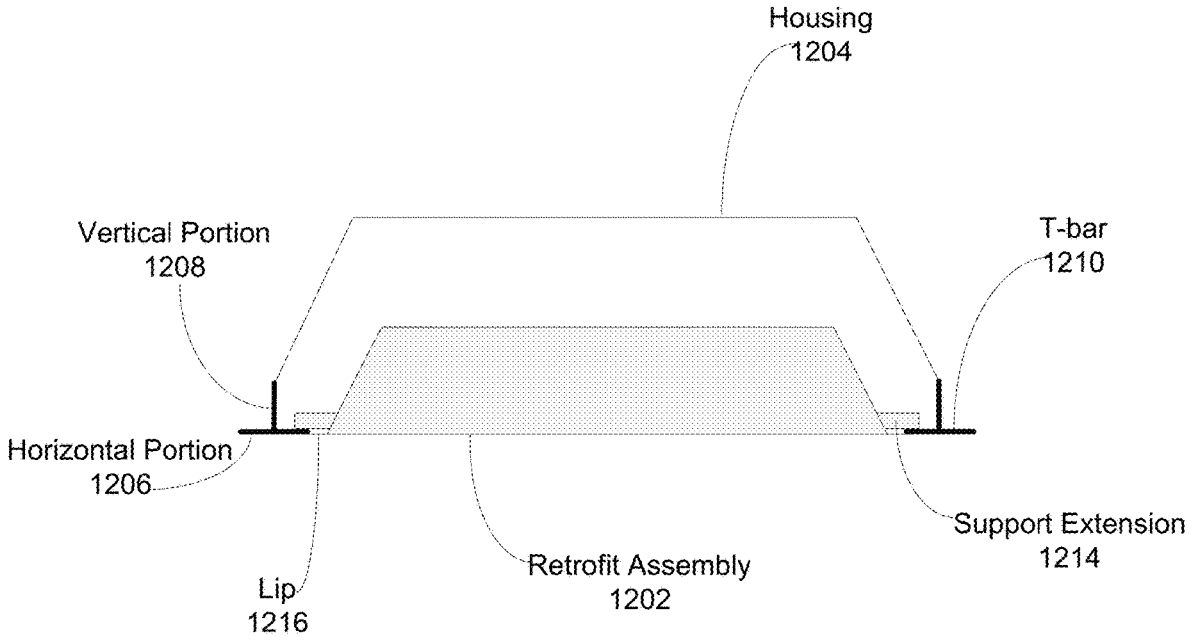
FIG. 12 illustrates a retrofit assembly in relationship to a troffer housing, according to at least one embodiment.

FIG. 12 illustrates a retrofit assembly in relationship to a troffer housing, according to at least one embodiment. Retrofit assembly 1202 may be placed within housing 1204. Housing 1204 may rest on horizontal portion 1206 and/or vertical portion 1208 of T-bar 1210, or it may be secured to T-bar 1210, e.g., screwed to T-bar 1210, or otherwise permanently attached to the ceiling system. For example, housing 1204 may be secured for use in earthquake zones and/or hurricane prone areas, or to comply with one or more building codes or requirements. Retrofit assembly 1202 may be supported on one or more T-bar 1210 by a pair of support extension 1214 disposed on opposite ends of its length. A top portion of retrofit assembly 1202's frame may be angled such that the retrofit assembly 1202 comprises a trapezoidal shape. This may allow the retrofit assembly 1202 to fit within housing 1204 of an existing light fixture. In addition, vertical portion 1208 of T-bar 1210 may prevent or limit lateral movement relative to the opening between two adjacent T-bar 1210.

Lip 1216 may optionally be disposed on the outer edges of retrofit assembly 1202, extending to its outer perimeter. Lip 1216 may overlap with a portion of T-bar 1210, and may allow retrofit assembly 1202 to be used in ceiling systems comprising a variety of T-bar 1210 widths in varying ceiling systems and/or a variety of gap size between a plurality of adjacent T-bar 1210. T-bar 1210 comprising a narrow width may result in a gap between T-bar 1210 and retrofit assembly 1202. Lip 1216 may extend outward from retrofit assembly 1202 and overlap with horizontal portion 1206 of T-bar 1210 such that lip 1216 minimizes or eliminates visible gaps. Lip 1216 may be uniform with a color of the frame, door assembly, and/or T-bar 1210. In some embodiments, lip 1216 may not be used, and an underside portion of support extension 1214 is painted a color, such as, e.g., black or white, such that the space between retrofit assembly 1202 and T-bar 1210 has a uniform appearance surrounding retrofit assembly 1202.

Figure 13A:
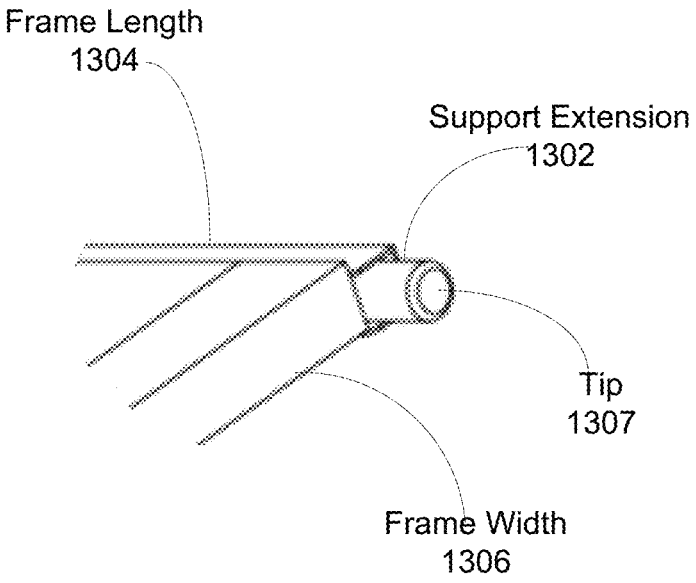
FIGS. 13A-B are views of a cylinder-shaped support extension, according to at least one embodiment.
Figure 13B:
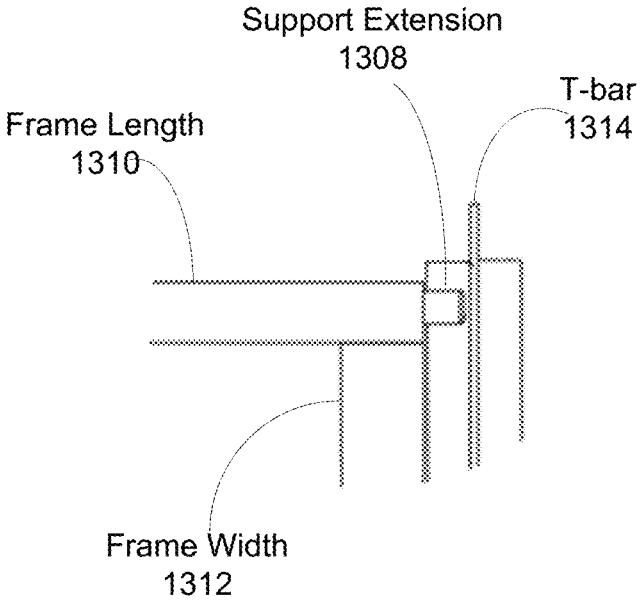

FIGS. 13A-B are views of a cylinder-shaped support extension, according to at least one embodiment. FIG. 13A is a perspective view of a support extension 1302 comprising a cylindrical support rod protruding from within frame length 1304 of the frame structure of a retrofit assembly. The cross-section of the support extension 1302 may be circular. The rod may fully extend from one end of the frame length 1304 to the other end of the frame length 1304. In some embodiments, the rod may not extend from within the frame structure, but may be attached or integrated to the outer edge of frame length 1304 or frame width 1306 of the frame structure. Support extension 1302 may be fixed in position, or it may be configured to move, such as, e.g., roll, slide or spin. Friction pads or strips, such as, e.g., rubber, may be disposed on the outer perimeter of the protruded portion of the rod configured to engage with a ceiling system for facilitating the rolling or sliding of the retrofit assembly onto a T-bar of the ceiling system. Tip 1307 of support extension 1302 may comprise a circular shape and a flat, convex or concave configuration. FIG. 13B is a top view of a retrofit assembly affixed to a ceiling system, according to at least one embodiment. Support extension 1308 may protrude from within frame length 1310, or it may be attached or integrated to the outer edge of frame length 1310 or frame width 1312 of the retrofit assembly. Support extension 1308 may protrude and extend over T-bar 1314 and support the weight of the retrofit assembly on a horizontal portion of T-bar 1314. In some embodiments, the end portion of support extension 1308, e.g., the tip, may be flushed and in contact with a vertical portion of T-bar 1314. In other embodiments, the tip of support extension 1308 does not reach, and is not in contact with, the vertical portion of T-bar 1314. The length of support extension 1308 may be adjustable, such as, e.g., comprising a screw-on system, a spring system, or pneumatic system. In further embodiments, support extension 1308 may have other configurations. For example, support extension 1308 may meet T-bar 1314 at an angle, such as, e.g. 15-, 30-, or 45-degrees.

Figure 14A:
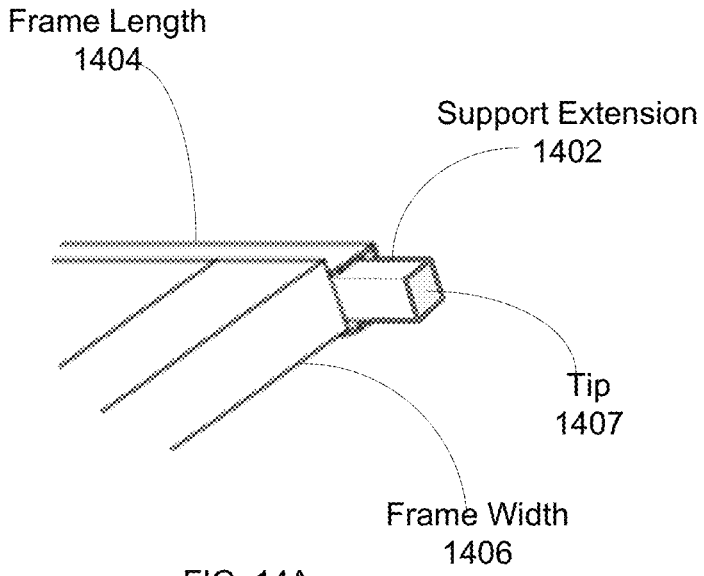
FIGS. 14A-B are views of a rectangular-cube-shaped support extension, according to at least one embodiment.
Figure 14B:
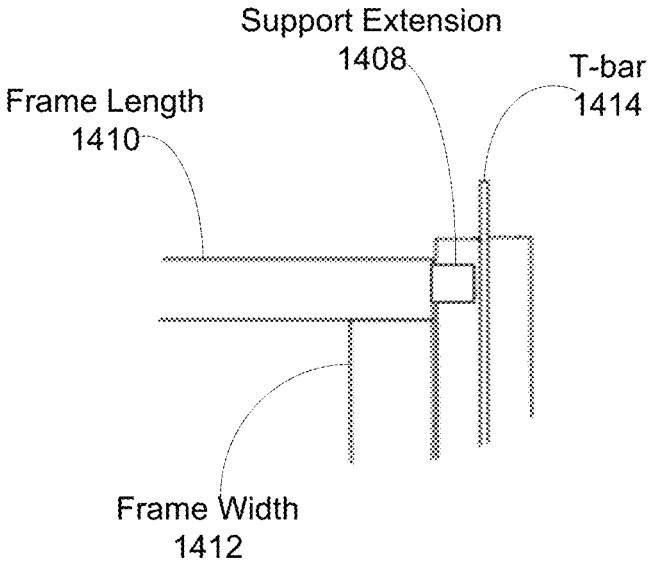

FIGS. 14A-B are views of a rectangular-cube-shaped support extension, according to at least one embodiment. FIG. 14A is a perspective view of a support extension 1402 comprising a rectangular-cube support rod protruding from within frame length 1404 of the frame structure of a retrofit assembly. The cross-section of the support extension 1402 may be square or rectangular. The rod may fully extend from one end of the frame length 1404 to the other end of the frame length 1404. In some embodiments, the rod may not extend from within the frame structure, but may be attached or integrated to the outer edge of frame length 1404 or frame width 1406 of the frame structure. Support extension 1402 may be fixed in position, or it may be configured to move, such as, e.g., roll, slide or spin. An advantage of the rectangular-cube configuration is that it may allow support extension 1402 to be more stable at rest compared to a cylindrical configuration due to its flat surfaces. Tip 1407 of support extension 1402 may comprise a square or rectangle shape, and a flat, convex or concave configuration. FIG. 14B is a top view of a retrofit assembly affixed to a ceiling system, according to at least one embodiment. Support extension 1408 may protrude from within frame length 1410, or it may be attached or integrated to the outer edge of frame length 1410 or frame width 1412 of the retrofit assembly. Support extension 1408 may protrude and extend over T-bar 1414 and support the weight of the retrofit assembly on a horizontal portion of T-bar 1414. In some embodiments, the end portion of support extension 1408, e.g., the tip, may be flushed and in contact with a vertical portion of T-bar 1414. In other embodiments, the tip of support extension 1408 does not reach, and is not in contact with, the vertical portion of T-bar 1414. The length of support extension 1408 may be adjustable, such as, e.g., comprising a screw-on system, a spring system, or pneumatic system. In further embodiments, support extension 1408 may have other configurations. For example, support extension 1408 may meet T-bar 1414 at an angle, such as, e.g. 15-, 30-, or 45-degrees.

Figure 15A:
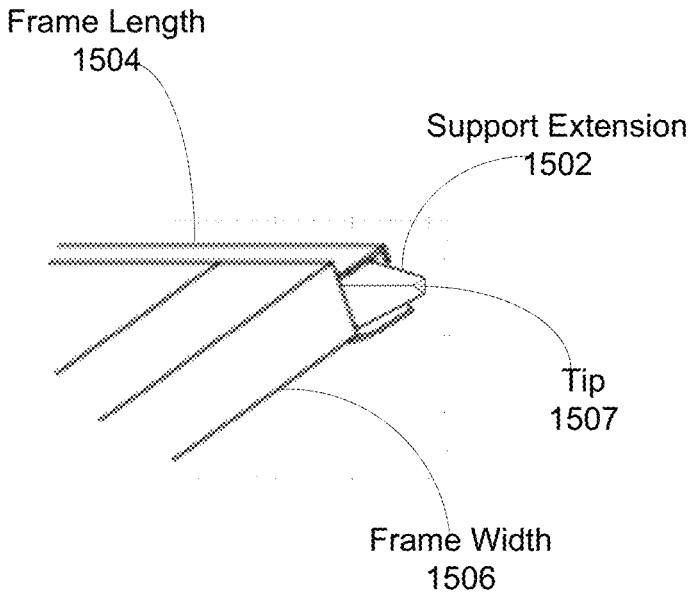
FIGS. 15A-B are views of a pyramid-shaped support extension, according to at least one embodiment.
Figure 15B:
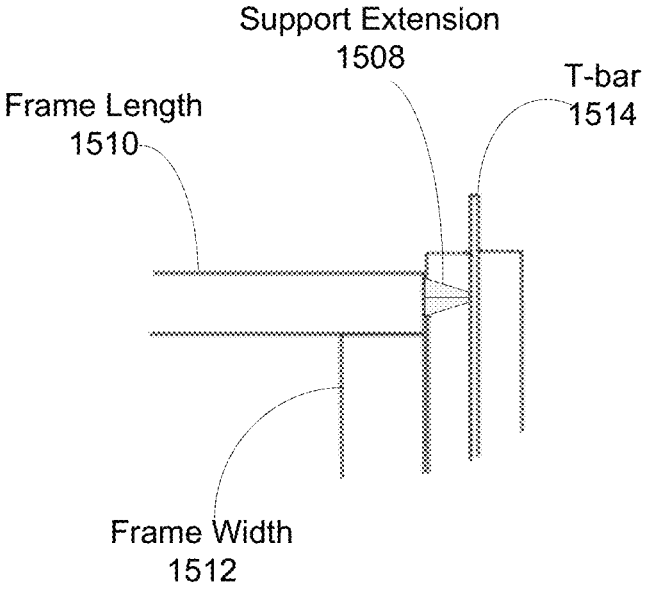

FIGS. 15A-B are views of a pyramid-shaped support extension, according to at least one embodiment. FIG. 15A is a perspective view of a support extension 1502 comprising a pyramidal support rod protruding from within frame length 1504 of the frame structure of a retrofit assembly. The cross-section of the support extension 1502 may be triangular. The rod may fully extend from one end of the frame length 1504 to the other end of the frame length 1504. In some embodiments, the rod may not extend from within the frame structure, but may be attached or integrated to the outer edge of frame length 1504 or frame width 1506 of the frame structure. Support extension 1502 may be fixed in position, or it may be configured to move, such as, e.g., roll, slide or spin. An advantage of the pyramid-shaped configuration is that it may allow support extension 1502 to be more stable at rest compared to a cylindrical configuration due to its flat surfaces. Tip 1507 of support extension 1502 may comprise a triangle shape and a flat, convex or concave configuration. In some embodiments, tip 1507 may be a pyramid shape, such that it comprises a pointy or sharp end. FIG. 15B is a top view of a retrofit assembly affixed to a ceiling system, according to at least one embodiment. Support extension 1508 may protrude from within frame length 1510, or it may be attached or integrated to the outer edge of frame length 1510 or frame width 1512 of the retrofit assembly. Support extension 1508 may protrude and extend over T-bar 1514 and support the weight of the retrofit assembly on a horizontal portion of T-bar 1514. In some embodiments, the end portion of support extension 1508, e.g., the tip, may be flushed and in contact with a vertical portion of T-bar 1514. In other embodiments, the tip of support extension 1508 does not reach, and is not in contact with, the vertical portion of T-bar 1514. The length of support extension 1508 may be adjustable, such as, e.g., comprising a screw-on system, a spring system, or pneumatic system. In further embodiments, support extension 1508 may have other configurations. For example, support extension 1508 may meet T-bar 1514 at an angle, such as, e.g. 15-, 30-, or 45-degrees.

Figure 16A:
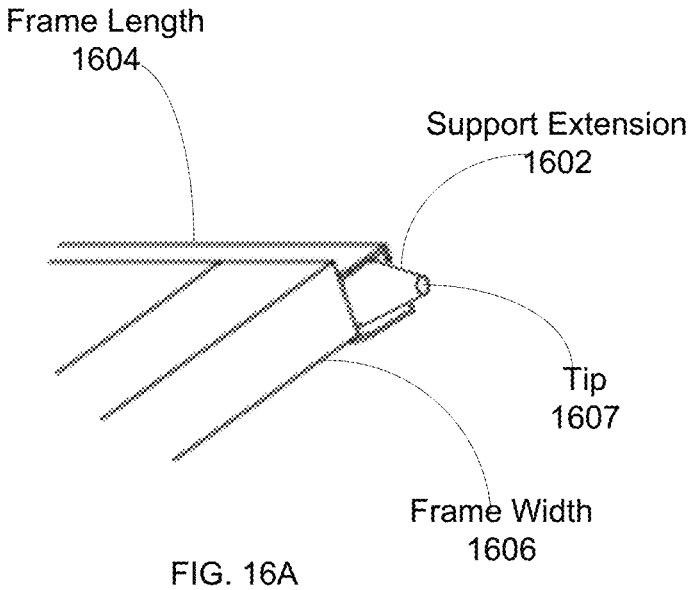
FIGS. 16A-B are views of a cone-shaped support extension, according to at least one embodiment.
Figure 16B:
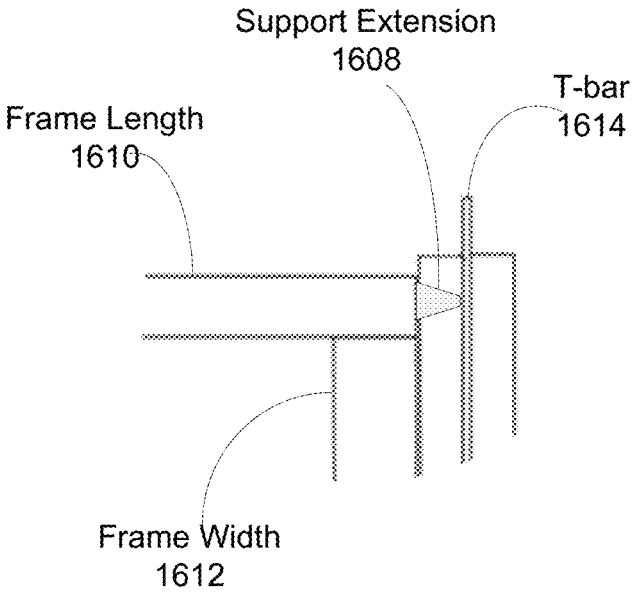

FIGS. 16A-B are views of a cone-shaped support extension, according to at least one embodiment. FIG. 16A is a perspective view of a support extension 1602 comprising a conical support rod protruding from within frame length 1604 of the frame structure of a retrofit assembly. The cross-section of the support extension 1602 may be circular. The rod may fully extend from one end of the frame length 1604 to the other end of the frame length 1604. In some embodiments, the rod may not extend from within the frame structure, but may be attached or integrated to the outer edge of frame length 1604 or frame width 1606 of the frame structure. Support extension 1602 may be fixed in position, or it may be configured to move, such as, e.g., roll, slide or spin. Friction pads or strips, such as, e.g., rubber, may be disposed on the outer perimeter of the protruded portion of the rod configured to engage with a ceiling system for facilitating the rolling or sliding of the retrofit assembly onto a T-bar of the ceiling system. Tip 1607 of support extension 1602 may comprise a circular shape and a flat, convex or concave configuration. In some embodiments, tip 1607 may be a cone shape, such that it comprises a pointy or sharp end. FIG. 16B is a top view of a retrofit assembly affixed to a ceiling system, according to at least one embodiment. Support extension 1608 may protrude from within frame length 1610, or it may be attached or integrated to the outer edge of frame length 1610 or frame width 1612 of the retrofit assembly. Support extension 1608 may protrude and extend over T-bar 1614 and support the weight of the retrofit assembly on a horizontal portion of T-bar 1614. In some embodiments, the end portion of support extension 1608, e.g., the tip, may be flushed and in contact with a vertical portion of T-bar 1614. In other embodiments, the tip of support extension 1608 does not reach, and is not in contact with, the vertical portion of T-bar 1614. The length of support extension 1608 may be adjustable, such as, e.g., comprising a screw-on system, a spring system, or pneumatic system. In further embodiments, support extension

1608 may have other configurations. For example, support extension 1608 may meet T-bar 1614 at an angle, such as, e.g. 15-, 30-, or 45-degrees.

Figure 17A:
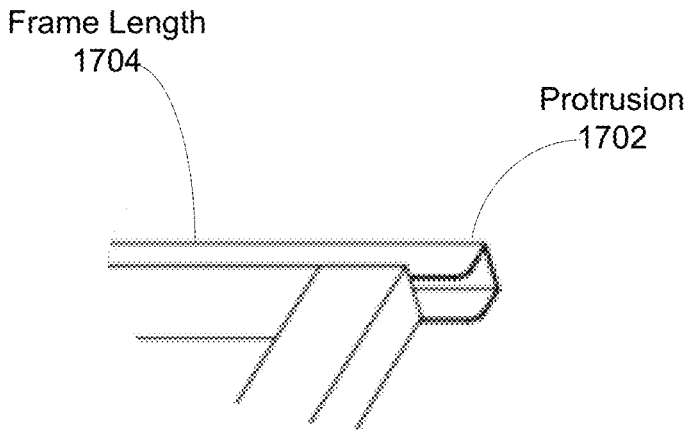
FIGS. 17A-B are views of a frame-based support extension, according to at least one embodiment.
Figure 17B:
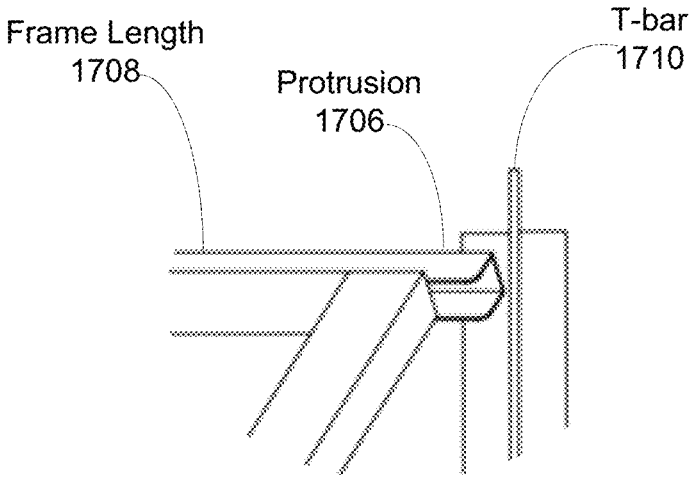

FIGS. 17A-B are views of a frame-based support extension, according to at least one embodiment. FIG. 17A is a perspective view of a frame of a retrofit assembly comprising a protrusion 1702 of frame length 1704. Protrusion 1702 may comprise the same shape and configuration as frame length 1704, such as, e.g., hollow cuboid-shaped. The cuboid shape may comprise three or four edges, and may be integrated with frame length 1704 such that it is an extension of frame length 1704, or it may be attached to frame length 1704 through a fastening mechanism, such as, e.g., screws, nuts and bolts, rivets, or an adhesive. FIG. 17B is a top view of a retrofit assembly affixed to a ceiling system, according to at least one embodiment. Protrusion 1706 may be attached or integrated to frame length 1708 and may extend over T-bar 1710 and support the weight of the retrofit assembly on a horizontal portion of T-bar 1710. In some embodiments, the end portion of protrusion 1706, e.g., the tip, may be flushed and in contact with a vertical portion of T-bar 1710. In other embodiments, the tip of protrusion 1706 does not reach, and is not in contact with, the vertical portion of T-bar 1710. In further embodiments, protrusion 1702 may have other configurations. For example, protrusion 1702 may meet T-bar 1710 at an angle, such as, e.g. 15-, 30-, or 45-degrees.

Figure 18A:
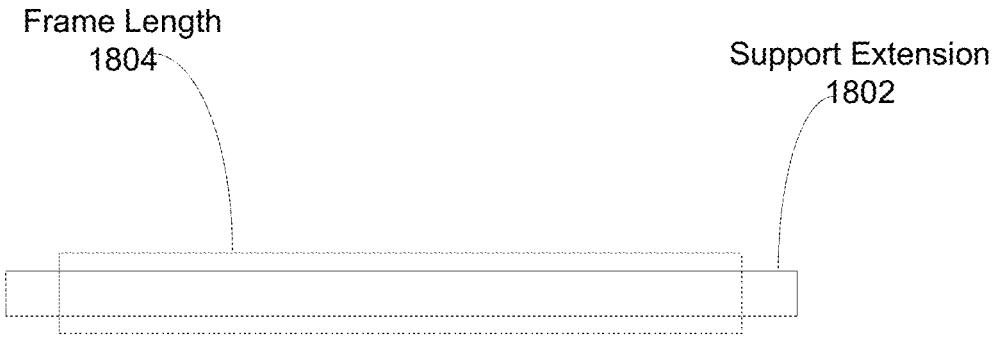
FIGS. 18A-C shows various alternative configurations of a support extension of a retrofit assembly, according to some embodiments.
Figure 18B:
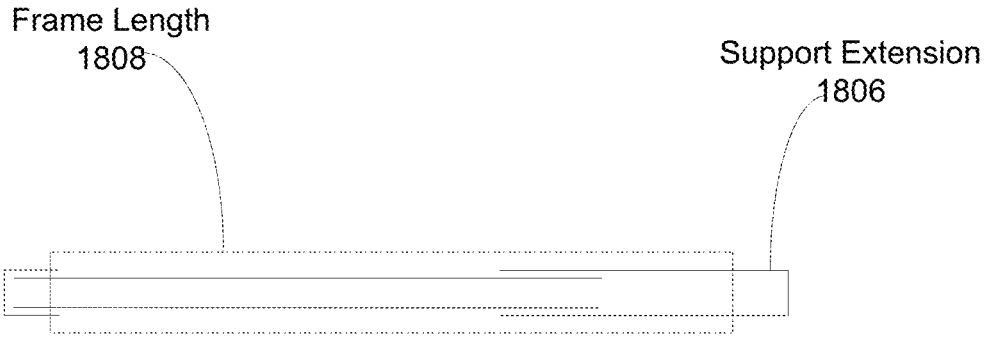
Figure 18C:
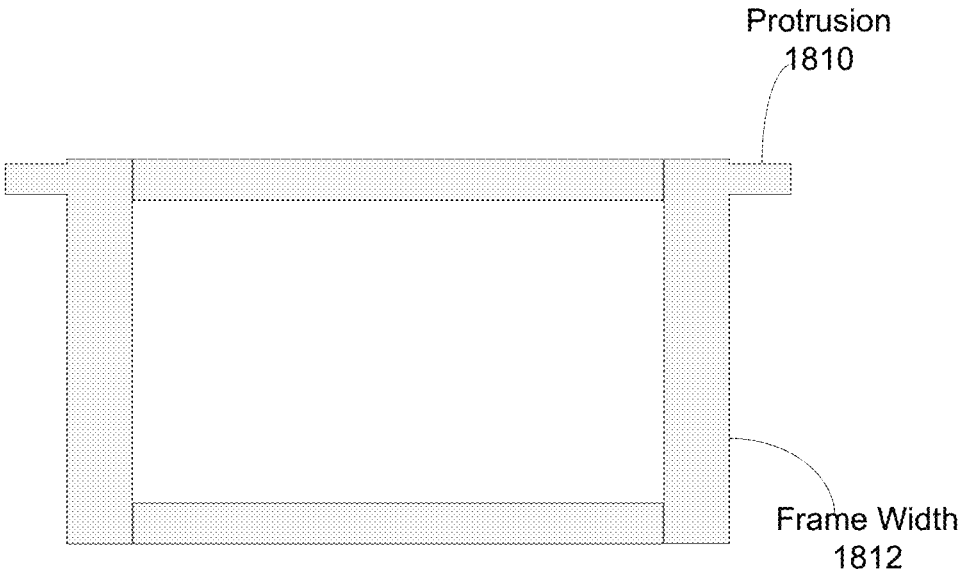

FIGS. 18A-C shows various alternative configurations of a support extension of a retrofit assembly, according to some embodiments. FIG. 18A is a support extension 1802 running the entire length of frame length 1804 such that it is extended from one end of frame length 1804 to the other end of frame length 1804. In some embodiments, support extension 1802 may not extend from within the frame structure, but may be attached or integrated to the outer edge of frame length 1804 or a frame width of a retrofit assembly. Support extension 1802 may be fixed in position, or it may be configured to move, such as, e.g., roll, slide or spin. Friction pads or strips, such as, e.g., rubber, may be disposed on the outer perimeter of the protruded portion of support extension 1802 configured to engage with the ceiling system for facilitating the rolling or sliding of the retrofit assembly onto a T-bar of a ceiling system. FIG. 18B is a support extension 1806 comprising a plurality of coupled parts running the entire length of frame length 1808 such that it is extended from one end of frame length 1808 to the other end of frame length 1808. Support extension 1806 may be fixed in position, or it may be configured to move, such as, e.g., roll, slide or spin. For example, support extension 1802 may comprise a middle rod configured to insert within two outer sleeve rods. The outer sleeve rods may comprise different lengths, or the same length. The outer sleeve rods may comprise the same diameter for even installation of the retrofit assembly. The length of support extension 1806 may be adjustable, such as, e.g., comprising a screw-on system, a spring system, or pneumatic system. Friction pads or strips, such as, e.g., rubber, may be disposed on the outer perimeter of the protruded portion of support extension 1806 configured to engage with a ceiling system for facilitating the rolling or sliding of the retrofit assembly onto a T-bar of the ceiling system. FIG. 18C is a protrusion 1810 integrated or permanently attached to frame width 1812 of a retrofit assembly through a fastening mechanism, such as, e.g., screws, nuts and bolts, rivets, or an adhesive. Protrusion 1810 may comprise the same shape and configuration as frame width 1812, such as, e.g., hollow cuboid-shaped. Protrusion 1810 may extend over the T-bar and support the weight of the retrofit assembly on a horizontal portion of the T-bar. In some embodiments, the end portion of protrusion 1810, e.g., the tip, may be flushed and in contact with a vertical portion of the T-bar. In other embodiments, the tip of protrusion 1810 does not reach, and is not in contact with, the vertical portion of the T-bar. In further embodiments, protrusion 1810 may have other configurations. For example, protrusion 1810 may meet the T-bar at an angle, such as, e.g. 15-, 30-, or 45-degrees.

Figure 19A:
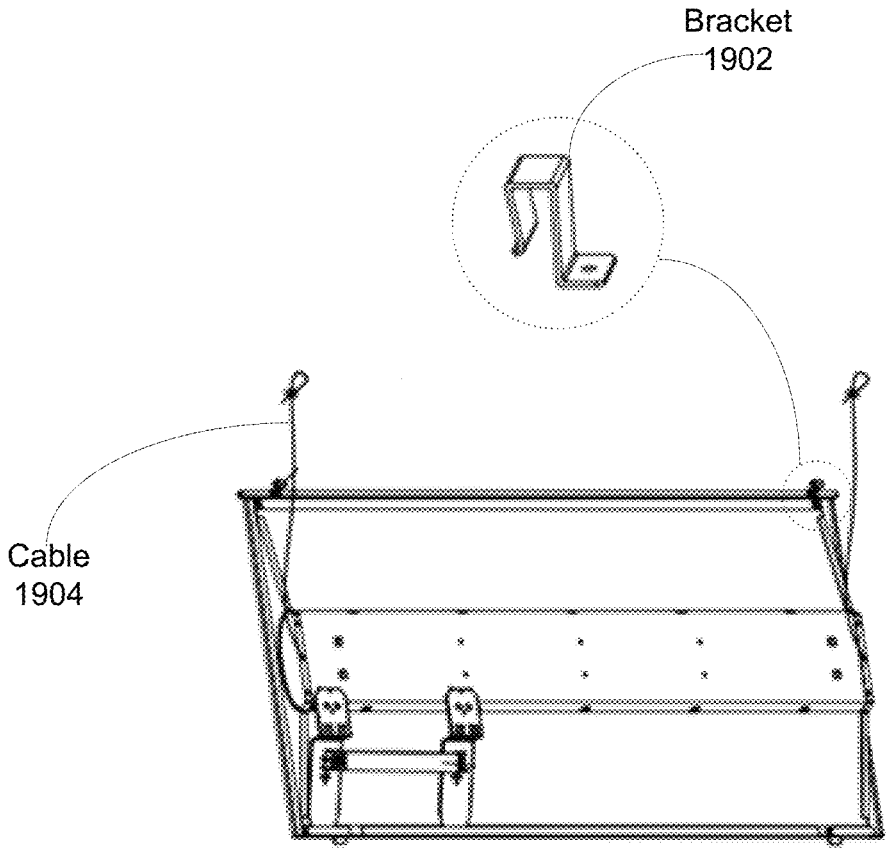
FIGS. 19A-B illustrate safety mechanisms of a retrofit assembly, according to at least one embodiment.
Figure 19B:
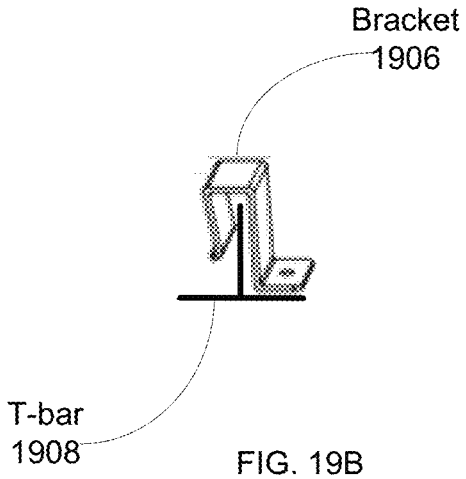

FIGS. 19A-B illustrate safety mechanisms of a retrofit assembly, according to at least one embodiment. In FIG. 19A, the retrofit assembly may comprise hang bracket 1902 and safety cable 1904 for complying with building codes, testing requirements, and/or other requirements related to new construction and/or retrofitting of existing troffer light fixtures. Bracket 1902 and safety cable 1904 may also make the installation process of the retrofit assembly easier and faster by requiring just a single installer to perform the job. Bracket 1902 may be hooked onto a vertical portion of a T-bar of a ceiling system such that it supports the weight of the retrofit assembly. Cable 1904 may be attached to a support structure of the retrofit assembly, and may be fastened to the ceiling system, such as, e.g., the T-bar, or a structure of an existing troffer light fixture, such as, e.g., a fixture housing. In FIG. 19B, hang bracket 1906 may comprise four distinct edges bent into a hook shape, such as, e.g., three edges of unequal lengths may form an open square shape, and a single edge may be bent into a right-angle, perpendicular with the longest edge towards the opposite side of the opening. The single edge may comprise a fastening means to attach bracket 1906 to the retrofit assembly, such as, e.g., a hole for a screw. The opening of bracket 1906 may latch or hook over a vertical portion of T-bar 1908 for supporting of the retrofit assembly.

In some embodiments, the retrofit assembly of the present invention may be wired to a ballast or electronics of the existing troffer light fixture, such as, e.g., a power source, controllers, automation systems, communication equipment, and sensors. However, the retrofit assembly may comprise components which are superior to those of an existing troffer light fixture, or not included in an existing troffer light fixture. Therefore, the ballast of the existing troffer fixture may be replaced with, or rewired to, a ballast of the retrofit assembly prior to installation of the retrofit assembly. This may provide an upgrade in the lighting system, such as, e.g., increases efficiency or functionality, uses less electricity, and gives of less heat.

Figure 20:
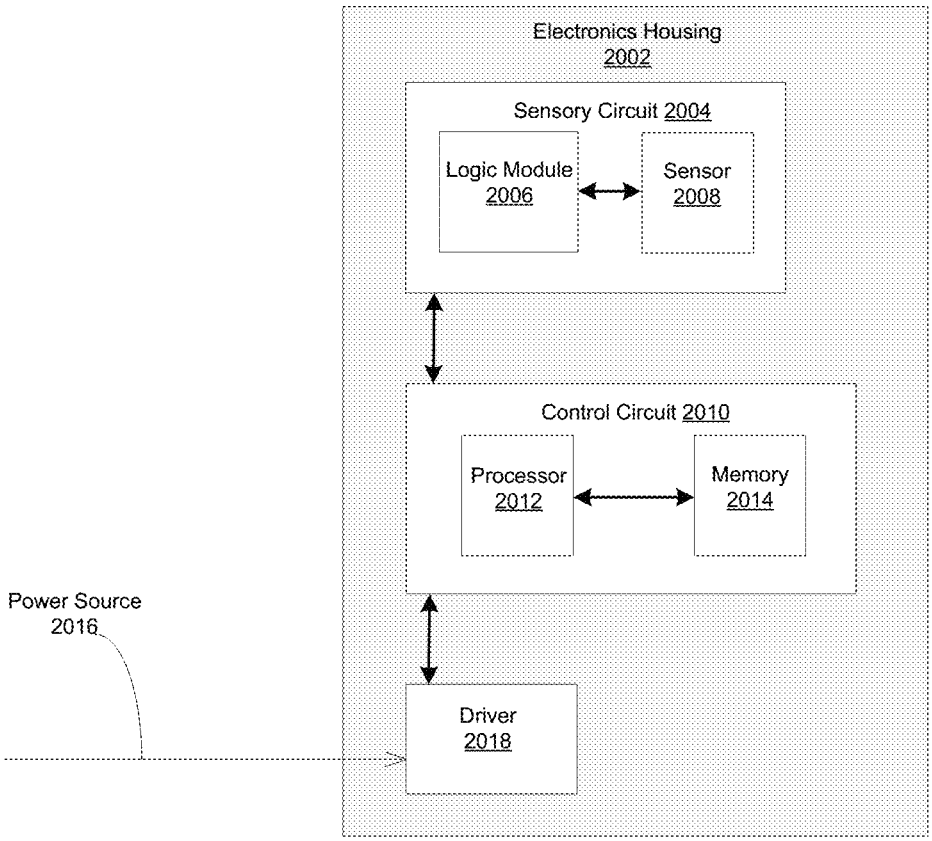
FIG. 20 is a schematic diagram of electronic components of a retrofit assembly, according to at least one embodiment.

FIG. 20 is a schematic diagram of electronic components of a retrofit assembly, according to at least one embodiment. The retrofit assembly may comprise various electronic components located within an electronics housing 2002 or cover. One or more components may be external such that it is located partially or completely outside of the housing or cover. The retrofit assembly's electronics may provide power and control light output of LEDs included in the retrofit assembly. External power source 2016 may be one or more electrical supply wires which enter the housing or cover, and may include components, such as, e.g., capacitors, modulators, transformers, batteries, and/or other components to regulate, alter, modify, or otherwise provide electrical power to the retrofit assembly. Driver 2018 may be electrically coupled to one or more LEDs in series and/or in parallel, and may control power supplied to the LEDs using techniques such as, e.g., pulse width modulation. By controlling the supply of electrical power to the LEDs, driver 2018 can control the light output of the LEDs, such as, e.g., intensity or color temperature. Two or more lead wires may electrically couple power source 2016 to driver 2018 and may be configured to allow electrical power to pass through to driver 2018. Driver 2018 may be coupled with, and controlled by, control circuit 2010.

Control circuit 2010 may comprise circuitry, hardware, and/or software for facilitating and/or performing functions such as, e.g., handle inputs, process inputs, run programs, handle instructions, route information, process data, generate outputs, communicate with other devices or hardware, and/or otherwise perform general or specific computing tasks. Control circuit 2010 may comprise a processor 2012 communicatively coupled to memory 2014. Processor 2012 can be, or include, an application specific integrated circuit (ASIC), one or more field programmable gate arrays (FPGAs), a digital-signal-processor (DSP), a group of processing components, or other suitable electronic processing components. Memory 2014 may include volatile memory and/or nonvolatile memory. Nonvolatile memory may include read only memory (ROM), programmable ROM (PROM), electrically programmable ROM (EPROM), electrically erasable ROM (EEPROM), or flash memory. Volatile memory may include random access memory (RAM), synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), or direct Rambus RAM (DRRAM). Memory 2014 may include database components, object code components, script components, or any other type of information structure for supporting various activities and information structures described herein. Memory 2014 may be communicatively coupled to processor 2012 and provide computer code or instructions to processor 2012 for executing the processes, such as, e.g., programming techniques, data manipulation techniques, and/or processing techniques such as using algorithms, routines, lookup tables, arrays, searching, databases, comparisons, and instructions.

Sensory circuit 2004 may contain circuitry, hardware, and/or software for facilitating or performing functions such as, e.g., handle inputs, process inputs, run programs, handle instructions, route information, process data, generate outputs, communicate with other devices or hardware, and/or otherwise perform general or specific computing tasks. Sensory circuit 2004 can be, or include, an application-specific integrated circuit (ASIC), one or more field programmable gate arrays (FPGAs), a digital-signal-processor (DSP), a group of processing components, or other suitable electronic processing components. Sensory circuit 2004 may be controlled by, and may provide sensor information to, control circuit 2010. Sensory circuit 2004 may include one or more logic module 2006, memory, and/or sensor 2008. Sensory circuit 2004 may provide retrofit assembly electronics information regarding the environment in which retrofit assembly operates. For example, sensor circuitry may detect motion with a motion sensor and may provide the information to control circuit 2010 which may cause control circuit 2010 to take action, such as, e.g., turning on one or more LEDs. Logic module 2006 may be implemented as hardware and/or software, and may provide code or instructions for carrying out or facilitating the functions of sensory circuit 2004, such as, e.g., comparing sensor data to threshold values, determining if movement has occurred using a variety of techniques, measuring ambient light, comparing ambient light measurements to threshold values, and formatting control signals for control circuit 2010. Sensory circuit 2004 may comprise one or more internal or external sensor 2008, such as, e.g., motion sensor, daylight sensor, microwave sensor, photodetector, bolometer, photoresistor, temperature sensor, and humidity sensor.

SUMMARY, BASICS

As described herein, the present invention discloses a retrofit assembly for retrofitting to a ceiling system comprising an existing troffer light fixture, or for new installation applications. The retrofit assembly may replace, repair or otherwise provide an upgrade to the existing fixture. For example, the retrofit assembly may comprise more efficient lamps, such as, e.g., LEDs, than the lamps of the existing troffer light fixture, such as, e.g., florescent lamps, incandescent lamps, halogen lamps, and/or less efficient LEDs. The system and the method of the present invention may allow retaining of components of the existing troffer light fixture, such as, e.g., troffer housing, ballast, and/or lamps. The method may be performed without the use of tools, such as, e.g., using no fasteners, drills, screwdrivers, wire cutters, or other tools to complete the retrofit. This in turn may decrease the time taken to perform the retrofit and may reduce costs and/or otherwise speed up the retrofitting of one or more existing troffer light fixtures.

Figure 21:
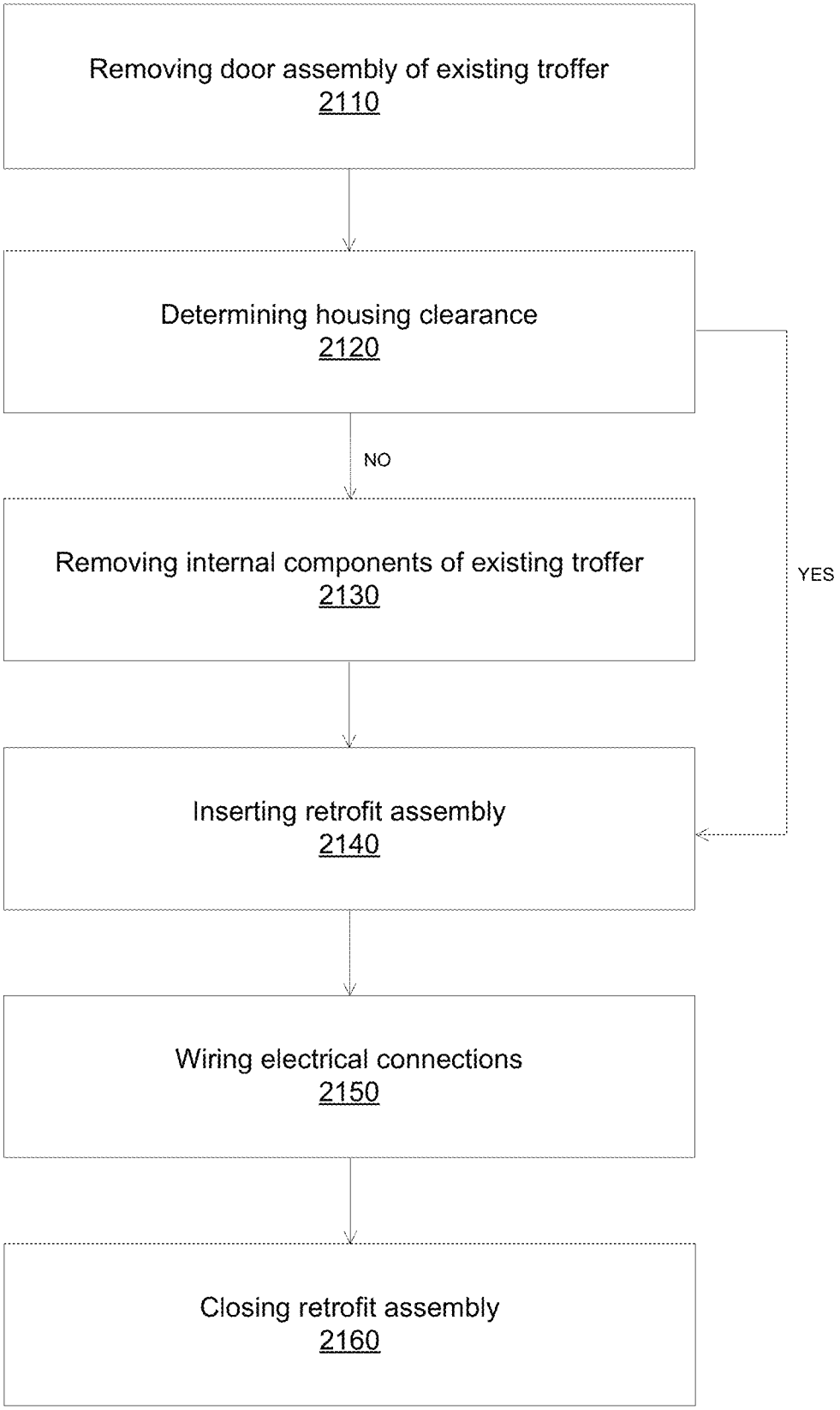
FIG. 21 is a flowchart of a method for retrofitting an existing troffer light fixture with a retrofit assembly, according to at least one embodiment.

FIG. 21 is a flowchart of a method for retrofitting an existing troffer light fixture with a retrofit assembly, according to at least one embodiment. Operation 2110 may remove a door assembly of an existing troffer light fixture. Removing the door assembly may comprise unlatching the assembly from a troffer housing of the existing fixture. A power source to the existing light fixture may be disconnected, e.g., disconnecting the wiring from a power source, using a breaker for later use prior to removing the door assembly or after removing the door assembly. Operation 2121 may determine whether clearance in the existing troffer housing is sufficient to permit installation of the retrofit assembly. This can include taking one or measurements, and/or consulting an instruction manual based on the particular make or model of the existing troffer light fixture being retrofitted. If clearance does not permit installation of the retrofit assembly, operation 2130 may remove internal components of the existing troffer light fixture to make room, such as, e.g., lamps, lamp holders, and/or ballast. However, if clearance does permit installation of the retrofit assembly then the existing troffer light fixture may be retrofitted without the need to remove and/or replace internal components. These components may be left within the troffer housing. Operation 2140 may insert a retrofit assembly through an opening, such as, e.g., by initially tilting the retrofit assembly sideways, created by T-bars of a ceiling system used to support the existing troffer light fixture. One or more support extensions of the retrofit assembly may be slid onto a horizontal portion of a T-bar, and may be configured to rest on, or secure to, the T-bar and hence the ceiling system. The support extensions may comprise a wider dimension than the opening of the T-bars, and thus prevents the retrofit assembly from falling through. In other embodiments, additional attachments, such as, e.g., hooks, hang brackets, and/or tethers, may be used to secure the retrofit assembly, such as, e.g., in an event of earthquakes or other disturbances. Operation 2150 may wire electrical connections, such as, e.g., a power source, supply wires, driver, control circuit, and sensors, previously disconnected from the existing troffer light fixture to the retrofit assembly. In some embodiments, twist-on wire connectors may be salvaged from the existing troffer light fixture. The retrofit assembly may optionally be hung from the ceiling system to free an installer's hands for the wiring of the electrical connections, such as, e.g., resting the retrofit assembly on T-bars with two or more support extensions, or hanging the retrofit assembly from the existing troffer housing, such as, e.g., using hooks, hang brackets, and/or hinges of the retrofit assembly. Operation 2160 may close the retrofit assembly using a locking mechanism, such as, e.g., a locking plate and/or a spring-load lock, which may be used to secure the retrofit assembly in position.

Figure 22:
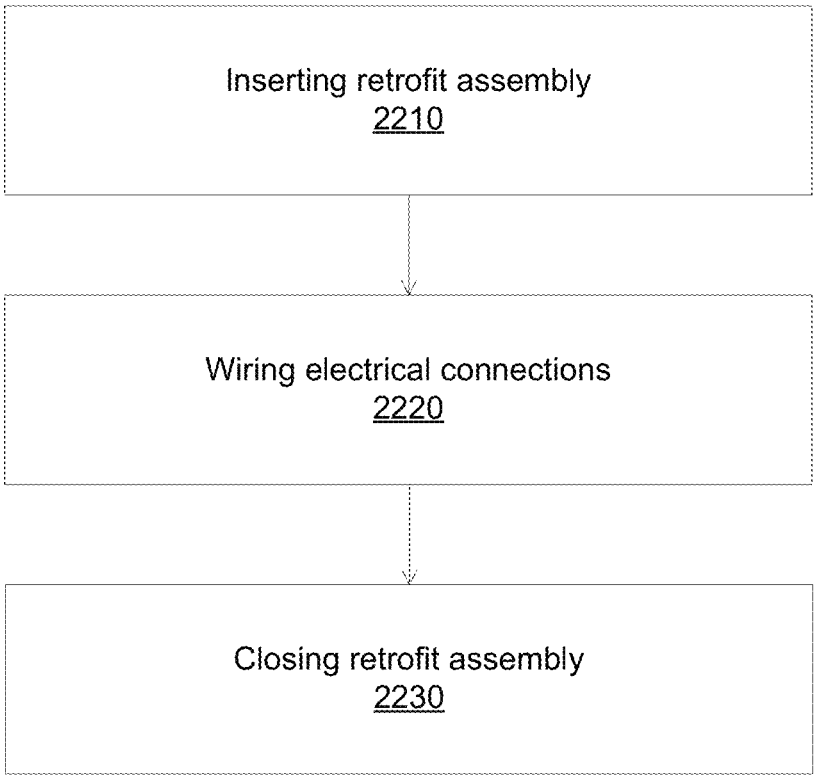
FIG. 22 is a flowchart of a method for installing a retrofit assembly in a new construction application, according to at least one embodiment.

FIG. 22 is a flowchart of a method for installing a retrofit assembly in a new construction application, according to at least one embodiment. Operation 2210 may insert a retrofit assembly through an opening, such as, e.g., by initially tilting the retrofit assembly sideways, created by T-bars of a ceiling system. In new construction applications, there may not be an existing troffer light fixture or an existing troffer housing. One or more support extensions of the retrofit assembly may be slid onto a horizontal portion of a T-bar, and may be configured to rest on, or secure to, the T-bar and hence the ceiling system. The support extensions may comprise a wider dimension than the opening of the T-bars, and thus prevents the retrofit assembly from falling through. In other embodiments, additional attachments, such as, e.g., hooks, hang brackets, and/or tethers, may be used to secure the retrofit assembly, such as, e.g., in an event of earthquakes or other disturbances. Operation 2220 may wire electrical connections to the retrofit assembly. In new construction applications, the retrofit assembly may be wired to power sources such as, e.g., wiring from a power circuit being installed along with the retrofit assembly. For example, wiring may run from a circuit for the purpose of powering new light fixtures. The wiring may be contained within a conduit and/or metal cable. In some embodiments, control devices, driver, sensors, and/or other components may be included with the retrofit assembly.

The retrofit assembly may optionally be hung from the ceiling system to free an installer's hands for the wiring of the electrical connections, such as, e.g., resting the retrofit assembly on T-bars with two or more support extensions, or hanging the retrofit assembly from the existing troffer housing, such as, e.g., using hooks, hang brackets, and/or hinges of the retrofit assembly. Operation 2230 may close the retrofit assembly using a locking mechanism, such as, e.g., a locking plate and/or a spring-load lock, may be used to secure the retrofit assembly in position.

Figure 23:
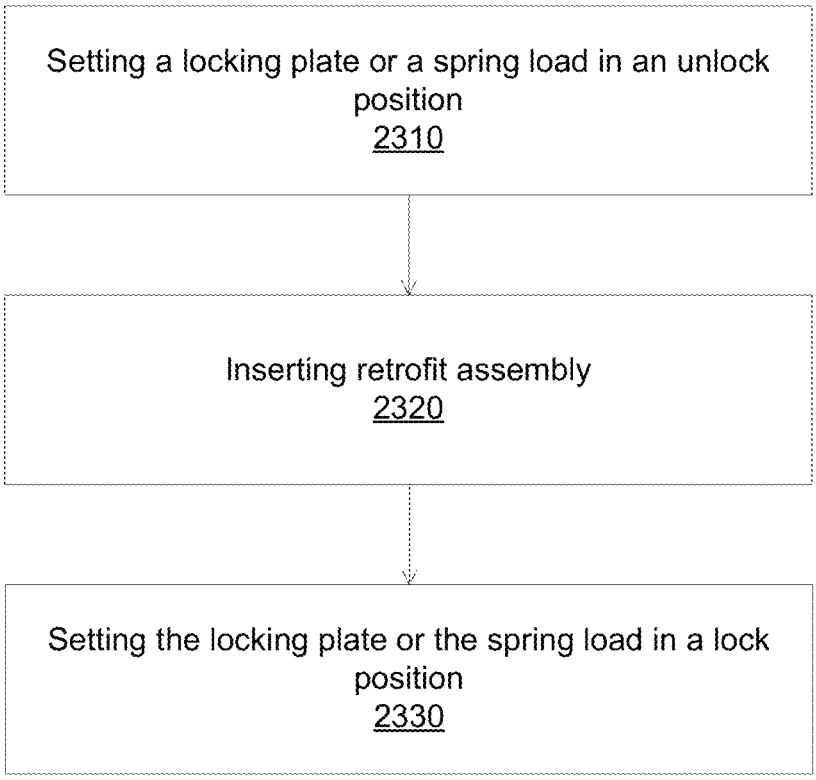
FIG. 23 is a flowchart of a method for setting a lock position and an unlock position of a retrofit assembly, according to at least one embodiment.

FIG. 23 is a flowchart of a method for setting a lock position and an unlock position of a retrofit assembly, according to at least one embodiment. Operation 2310 sets a locking plate or a spring load attached the retrofit assembly in an unlock position. The unlock position of the locking plate or the spring load may comprise a decreased length of the locking plate or spring load such that the retrofit assembly fits within a ceiling system's grid structure, e.g., T-bars. Operation 2320 inserts the retrofit assembly through the ceiling system's grid structure. Operation 2330 sets the locking plate or the spring load in a lock position. The lock position of the locking plate or the spring load may comprise an increased length of the locking plate or spring load such that the retrofit assembly does not fit through the ceiling system's grid structure, and thus preventing the retrofit assembly from falling through. The locking plate may be rotated about an axis such that its configuration is changed from a decreased length to an increased length. The spring load may be put at rest such that its configuration is changed from a decreased length to an increased length.

A number of embodiments have been described. Nevertheless, it will be understood that various modifications may be made without departing from the spirit and scope of the claimed invention. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

It may be appreciated that the various systems, methods, and apparatus disclosed herein may be embodied in a machine-readable medium and/or a machine accessible medium, and/or may be performed in any order. The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

The invention claimed is:

1. A system, comprising:
a frame comprising four side walls,
wherein the side walls form a square or rectangle shape;
a recessed cavity;
one or more lens;
a light source;
at least one support extension configured as a horizontal protrusion for supporting the frame,
wherein a pair of the at least one support extensions is disposed on upper or lower opposite ends of the frame's length,
wherein the pair support extension is configured to engage a horizontal surface of a T-bar of a ceiling system, and
wherein the at least one support extension is configured into a hollow cuboid shape comprising three edges.

2. A retrofit assembly, comprising:
a frame comprising four side walls,
a recessed cavity;
one or more lens;
a light source,
a door assembly,
at least one support extension configured as a horizontal protrusion for supporting the frame,
wherein the at least one support extension is configured to be secured to a T-bar for minimizing movement of the retrofit assembly;
a lip extending to an outer perimeter of the frame for reducing a gap size between the frame and the T-bar,
wherein the lip comprises a uniform color with the frame, the door assembly, or the T-bar, or any combination thereof, and
wherein the at least one support extension comprises a friction pad on an outer perimeter configured to engage with a horizontal portion of the T-bar.

3. A retrofit assembly, comprising:
a frame comprising four side walls,
a recessed cavity;
one or more lens;
a light source,
a door assembly,
at least one support extension configured as a horizontal protrusion for supporting the frame,
wherein the at least one support extension is configured to be secured to a T-bar for minimizing movement of the retrofit assembly;
a lip extending to an outer perimeter of the frame for reducing a gap size between the frame and the T-bar, wherein the lip comprises a uniform color with the frame, the door assembly, or the T-bar, or any combination thereof;

at least one locking plate disposed on an end of the retrofit assembly's width, and wherein the at least one locking plate is rotatable between an unlock position comprising a reduced length, and a locked position comprising an increased length.

* * * * *